US011811167B2

(12) United States Patent
Hirota

(10) Patent No.: US 11,811,167 B2
(45) Date of Patent: Nov. 7, 2023

(54) LEVER-TYPE CONNECTOR

(71) Applicant: SUMITOMO WIRING SYSTEMS, LTD., Mie (JP)

(72) Inventor: Masanori Hirota, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/698,785

(22) Filed: Mar. 18, 2022

(65) Prior Publication Data

US 2022/0320797 A1 Oct. 6, 2022

(30) Foreign Application Priority Data

Mar. 30, 2021 (JP) ..... 2021-058027

(51) Int. Cl.
*H01R 13/629* (2006.01)

(52) U.S. Cl.
CPC ..... *H01R 13/62938* (2013.01)

(58) Field of Classification Search
CPC ..... H01R 13/62938; H01R 13/629; H01R 13/62933; H01R 13/62955; H01R 13/631; H01R 13/633; H01R 13/6335
See application file for complete search history.

(56) References Cited

U.S. PATENT DOCUMENTS 5,344,194 A * 9/1994 Hatagishi ..... H01R 13/62933 285/308
5,460,534 A * 10/1995 Taniuchi ..... H01R 13/62938 439/372
5,676,556 A * 10/1997 Yamaguchi ..... H01R 13/62933 439/157
5,823,809 A * 10/1998 Wakata ..... H01R 13/5202 439/157
5,876,225 A 3/1999 Katsuma et al.
5,957,710 A * 9/1999 Nagano ..... H01R 13/193 439/157
7,255,580 B2 * 8/2007 Foltz ..... H01R 13/62955 439/157
7,476,116 B2 * 1/2009 Shinozaki ..... H01R 13/62938 439/345

* cited by examiner

*Primary Examiner* — Vanessa Girardi
(74) *Attorney, Agent, or Firm* — Venjuris, P.C.

(57) ABSTRACT

A first housing is formed with an escaping groove into which a cam pin is insertable. A lever to be assembled with the first housing is provided with a locking protrusion capable of holding the lever in a rotation restricted state by locking an edge part of the escaping groove. A second housing is provided with a first pressing portion for deforming the lever in a direction separating from the first housing by coming into contact with the lever, and a second pressing portion for releasing the rotation restricted state of the lever by coming into contact with the locking protrusion. The first pressing portion first comes into contact with the lever, and the second pressing portion is set to come into contact with the locking protrusion with the lever deformed in the direction separating from the first housing.

4 Claims, 25 Drawing Sheets

< Related Art >

< Related Art >

LEVER-TYPE CONNECTOR

CROSS-REFERENCE TO RELATED APPLICATIONS

This application is based on and claims priority from Japanese Patent Application No. 2021-058027, filed on Mar. 30, 2021, with the Japan Patent Office, the disclosure of which is incorporated herein in their entireties by reference.

TECHNICAL FIELD

A technique disclosed in this specification relates to a lever-type connector.

BACKGROUND

A lever-type connector is configured such that one and the other housings are connected by a cam action by rotating a lever after the lever including a cam groove is mounted on the one housing and the both housings are brought closer to cause a follower pin formed on the other housing to enter the cam groove. Accordingly, in the connector of this type, the lever needs to be held at a predetermined initial position so that the follower pin can properly enter the cam groove at the time of initial connection.

Conventionally, a means for holding a lever at an initial position is known from Japanese Patent Laid-open Publication No. H09-223539. According to this means, locking protrusions 6 are formed on side edges of the entrances of cam grooves 2 in a lever 3 and locked to side edges of escaping grooves 7 formed in a housing 1 as shown in FIGS. 24 and 25, whereby the lever 3 is held in a rotation restricted state from an initial position. On the other hand, a mating housing 4 is formed with pressing portions 8 on base end sides of follower pins 5. When the both housings 1, 4 are initially fit, the pressing portions 8 enter the escaping grooves 7 and ride on inner sides of the locking protrusions 6 as shown by an arrow x of FIG. 25 and the locking protrusions 6 push the escaping grooves 7 outwardly while opening the tips of the lever 3 as shown by an arrow y of FIG. 25, with the result that the rotation restriction of the lever 3 is released.

SUMMARY

However, in the above configuration, the locking protrusions 6 may be broken since strong forces are applied to the locking protrusions 6 when the pressing portions 8 ride on the locking protrusions 6. To enhance the strength of the locking protrusions 6, it is considered to make dimensions of the locking protrusions 6 larger, but the enlargement of the locking protrusions 6 is not preferable since it leads to the enlargement of the lever 3 and, consequently, of the connector in terms of the configuration of the escaping grooves 7.

The technique disclosed in this specification is directed to a lever-type connector with a first housing including a receptacle, a second housing including a cam pin, the second housing being fit into the receptacle, and a lever provided rotatably on the first housing, the lever including a cam groove for receiving the cam pin, the cam pin being introduced into the cam groove of the lever at an initial position in a connection initial stage of the both housings, the both housings being connected by a cam action between the cam groove and the cam pin as the lever is rotated, wherein the receptacle of the first housing is formed with an escaping groove open forward in a connecting direction, the cam pin being insertable into the escaping groove, the lever is provided with a locking protrusion capable of holding the lever in a rotation restricted state from the initial position by projecting toward the escaping groove and locking an edge part of the escaping groove, the second housing is provided with a first pressing portion projecting outwardly of the second housing and configured to come into contact with the lever and deform the lever in a direction separating from the first housing when the cam pin enters the cam groove of the lever set at the initial position, and a second pressing portion projecting outwardly of the second housing and configured to come into contact with the locking protrusion by entering the escaping groove together with the cam pin and release the rotation restricted state of the lever by pushing the locking protrusion in a direction to be disengaged from the edge part of the escaping groove, and the first pressing portion first comes into contact with the lever and the second pressing portion is set to come into contact with the locking protrusion with the lever deformed in the direction separating from the first housing when the both housings are connected.

According to the lever-type connector disclosed in this specification, it can be suppressed that a force concentrates on the locking protrusion holding the lever to break the locking protrusion when rotation restriction is released.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
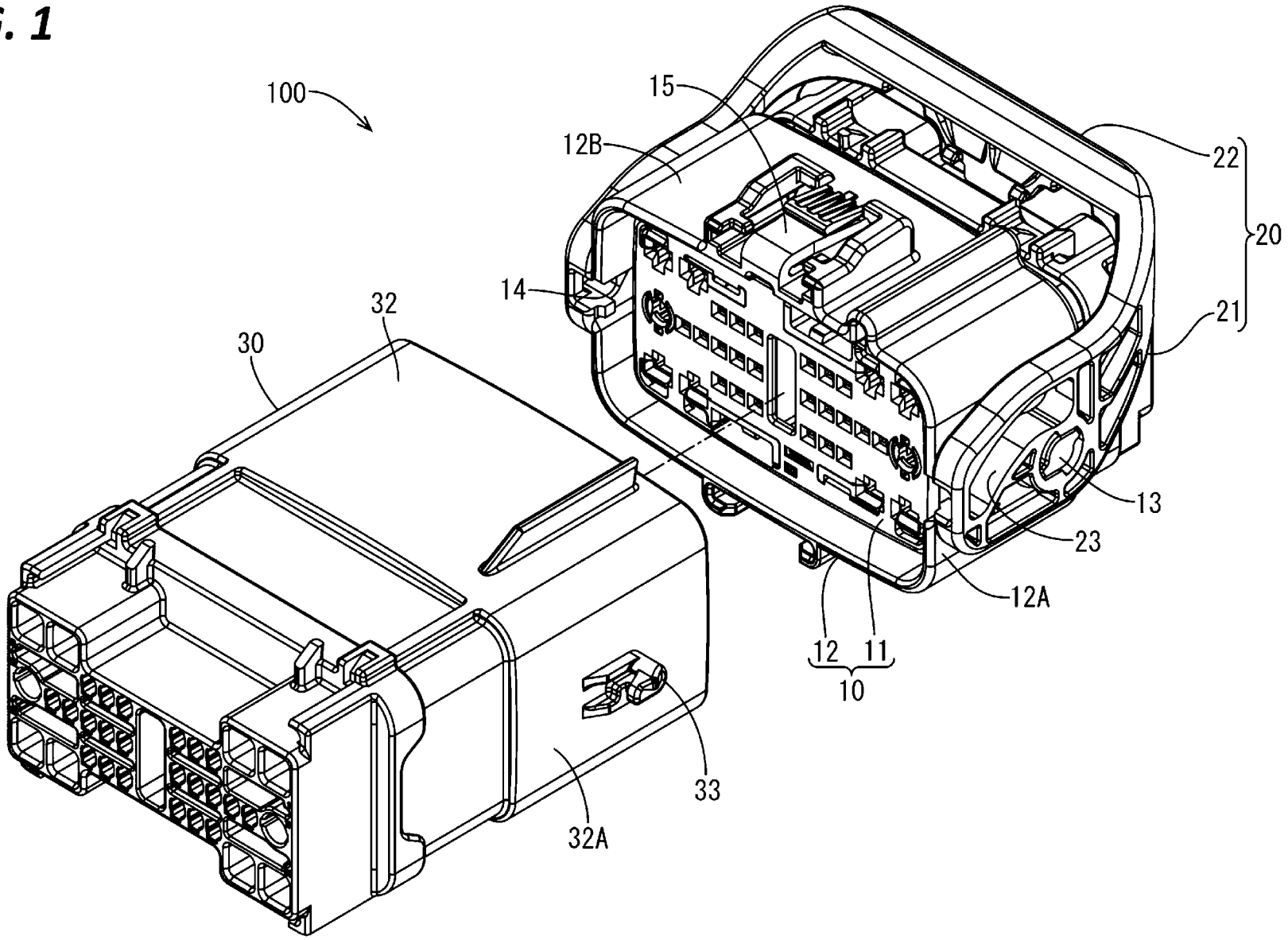
FIG. 1 is a perspective view of a lever-type connector of an embodiment before connection.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Summary of Embodiments (1) The technique disclosed in this specification is directed to a lever-type connector with a first housing including a receptacle, a second housing including a cam pin, the second housing being fit into the receptacle, and a lever provided rotatably on the first housing, the lever including a cam groove for receiving the cam pin, the cam pin being introduced into the cam groove of the lever at an initial position in a connection initial stage of the both housings, the both housings being connected by a cam action between the cam groove and the cam pin as the lever is rotated, wherein the receptacle of the first housing is formed with an escaping groove open forward in a connecting direction, the cam pin being insertable into the escaping groove, the lever is provided with a locking protrusion capable of holding the lever in a rotation restricted state from the initial position by projecting toward the escaping groove and locking an edge part of the escaping groove, the second housing is provided with a first pressing portion projecting outwardly of the second housing and configured to come into contact with the lever and deform the lever in a direction separating from the first housing when the cam pin enters the cam groove of the lever set at the initial position, and a second pressing portion projecting outwardly of the second housing and configured to come into contact with the locking protrusion by entering the escaping groove together with the cam pin and release the rotation restricted state of the lever by pushing the locking protrusion in a direction to be disengaged from the edge part of the escaping groove, and the first pressing portion first comes into contact with the lever and the second pressing portion is set to come into contact with the locking protrusion with the lever deformed in the direction separating from the first housing when the both housings are connected.

According to the above configuration, a locked state of the locking protrusion to the escaping groove can be released by deforming the lever in two stages by the first and second pressing portions. Thus, a contact angle between the second pressing portion and the locking protrusion can be reduced and a force applied to the second pressing portion and the locking protrusion can be reduced as compared to a conventional configuration not provided with the first pressing portion. Hence, the shape degradation (squeezing) of the second pressing portion and the locking protrusion can be suppressed. Further, a force required to connect the both housings can be reduced and workability is improved.

(2) A coupling portion coupling end parts of facing groove walls of the cam groove on a side opposite to the first housing may be provided at an entrance of the cam groove into which the cam pin is introduced, and the first pressing portion may move the lever in the direction separating from the first housing by coming into contact with the coupling portion.

According to the above configuration, a specific configuration for bringing the first pressing portion into contact with the lever can be realized.

(3) The first pressing portion may project in a projecting direction of the cam pin from a tip of the cam pin. According to the above configuration, the first pressing portion can be provided by a simple configuration.

(4) A part of the coupling portion disposed on the entrance side of the cam groove and on the first housing side may serve as a guiding surface obliquely inclined with respect to a moving direction of the first pressing portion to guide the first pressing portion to an inner side of the coupling portion, and a part of the coupling portion disposed on a side opposite to the entrance may serve as a partial connection locking portion intersecting the moving direction of the cam pin.

According to the above configuration, because of the guiding surface, the lever can be smoothly moved by the first pressing portion. Further, when the first pressing portion passes the coupling portion and the lever moves in a direction toward the first housing, the partial connection locking portion locks the first pressing portion to prevent a receding movement of the first pressing portion. Thus, a partially connected state can be set in which the first and second housings are hardly separated.

Details of Embodiment

A specific example of the technique disclosed by this specification is described below with reference to the drawings. Note that the present disclosure is not limited to these illustrations and is intended to be represented by claims and include all changes in the scope of claims and in the meaning and scope of equivalents.

Embodiment

One embodiment is described with reference to FIGS. 1 to 23. A lever-type connector 100 of this embodiment includes, as shown in FIG. 1, a female connector housing 10 (an example of a first housing; hereinafter referred to as a female housing), a male connector housing 30 (an example of a second housing; hereinafter referred to as a male housing), and a lever 20 to be mounted on the female housing 10.

Note that a connection surface side is described as a front side in each of the housings 10, 30 below.

[Female Housing 10]

Figure 2:
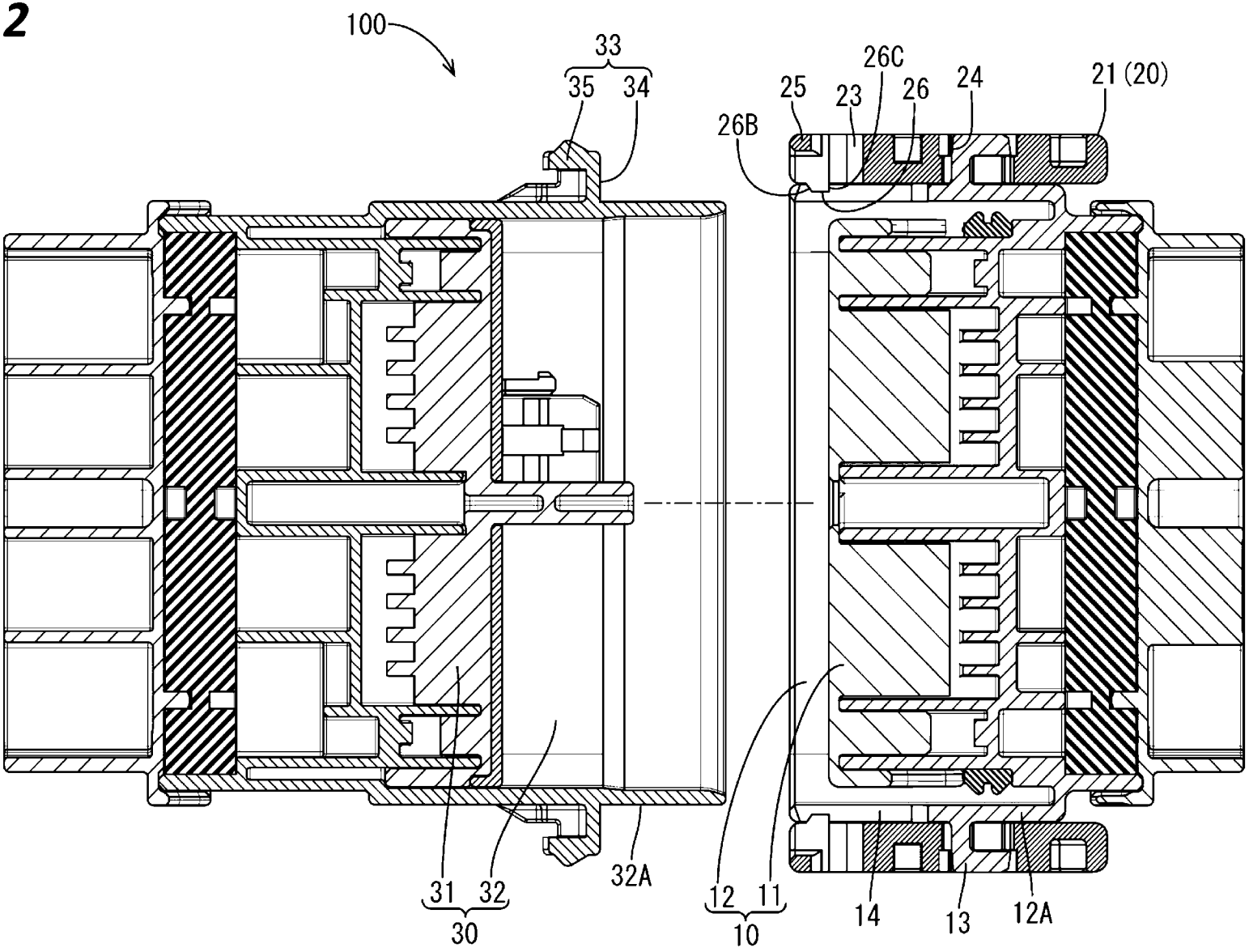
FIG. 2 is a horizontal section of the lever-type connector of the embodiment before connection.
Figure 3:
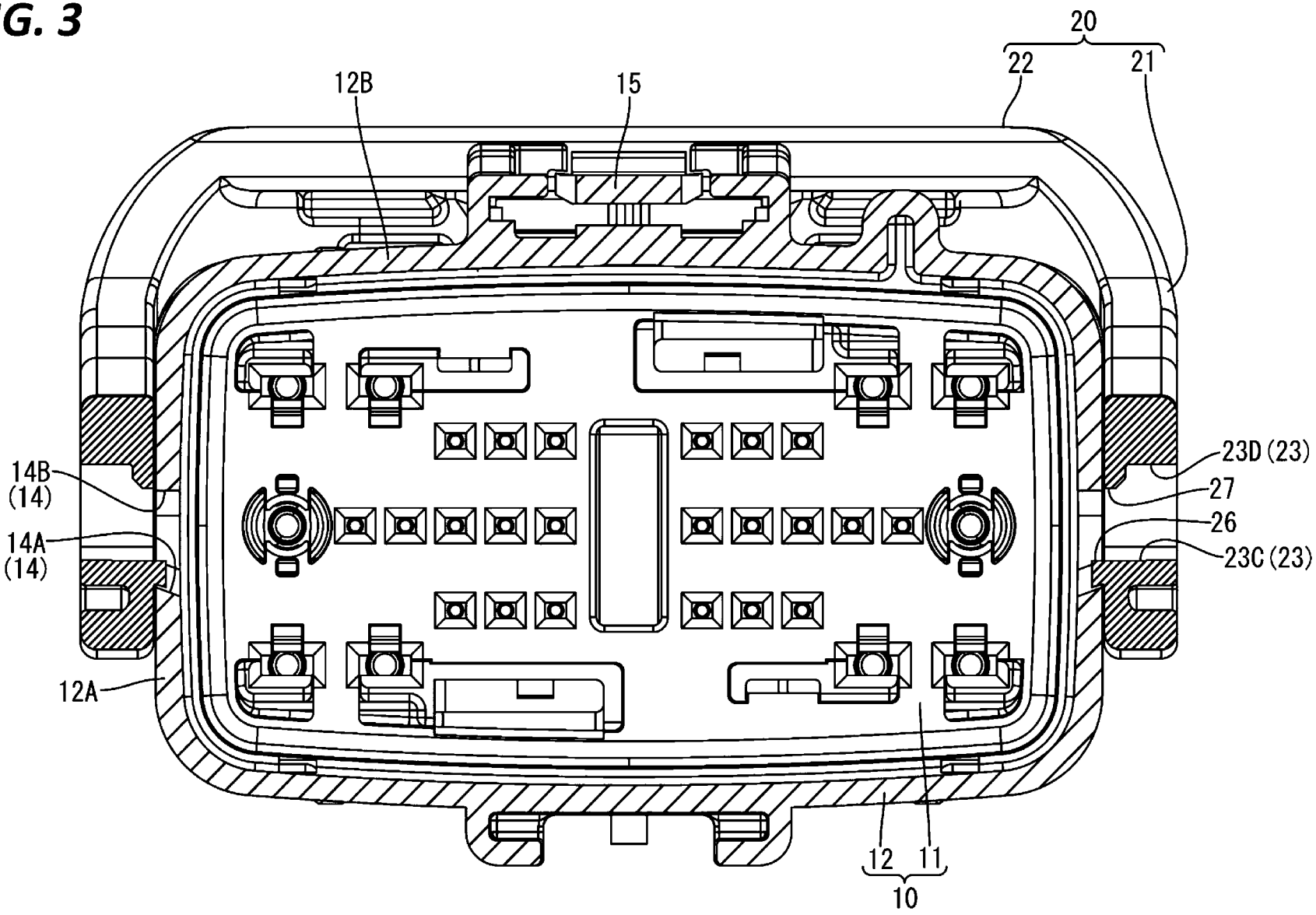
FIG. 3 is a vertical section of a female housing and a lever of the embodiment before connection.

The female housing 10 is made of synthetic resin and in the form of a rectangular parallelepiped block as a whole. As shown in FIGS. 1 to 3, the female housing 10 includes a female terminal holding portion 11 for holding terminals (not shown) and a female receptacle (an example of a receptacle) 12 surrounding the female terminal holding portion 11 and open forward. The terminals held in the female terminal holding portion 11 are, for example, female terminals.

The female receptacle 12 is shaped to protrude forward from the female terminal holding portion 11. As shown in FIGS. 1 and 2, a pair of support shafts 13 project on the outer surfaces of left and right side walls 12A of the female receptacle 12. Each support shaft 13 is provided in a central part of the outer surface of the side wall 12A.

Figure 6:
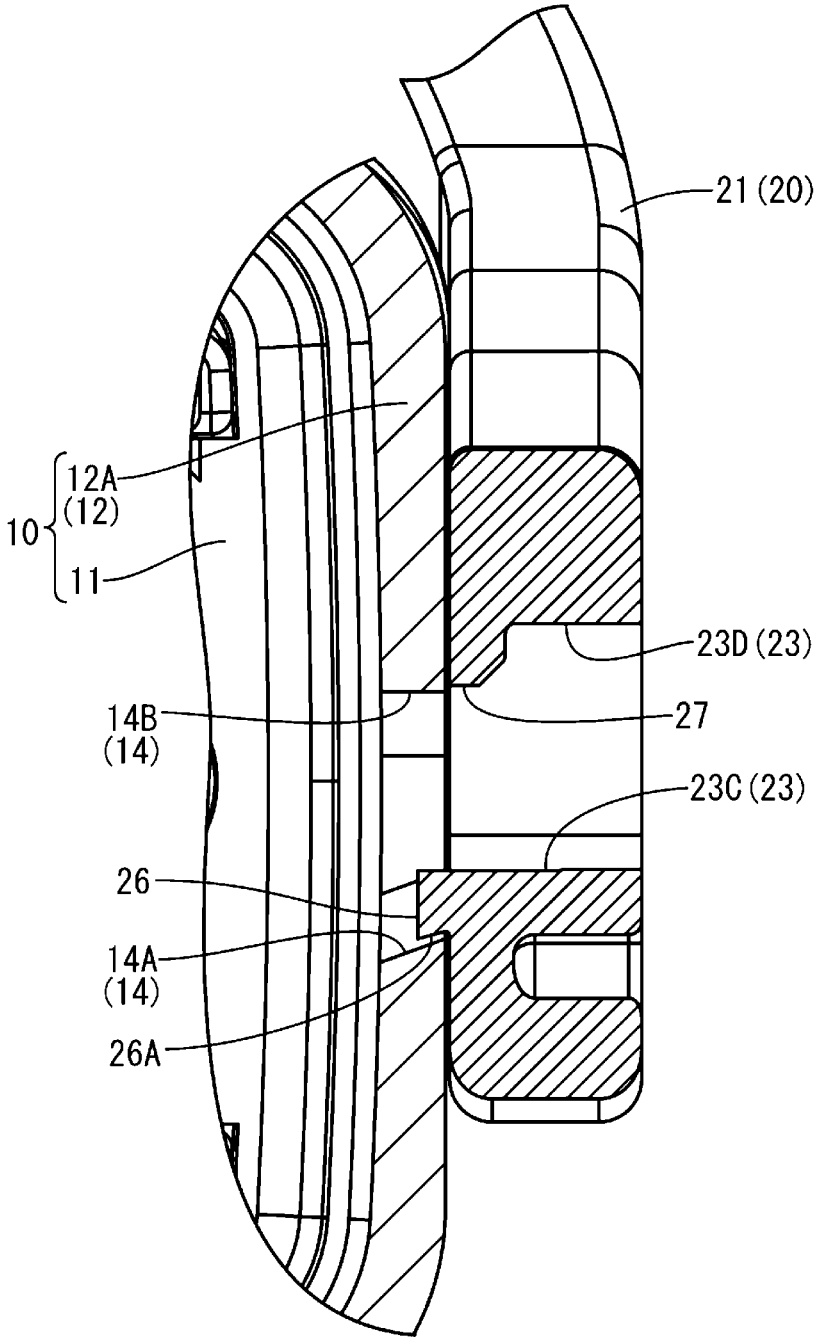
FIG. 6 is a partial enlarged vertical section of the female housing and the lever of the embodiment.

The female receptacle 12 is formed with escaping grooves 14, into which cam pins 33 are inserted and which extend in a front-rear direction. The escaping groove 14 linearly extends from a position forward of the support shaft 13 by a predetermined dimension to the front end of the female receptacle 12. Further, out of upper and lower groove walls of the escaping groove 14 facing each other, a lower groove wall 14A located below is inclined to expand in diameter toward an inner side of the female receptacle 12 as shown in FIGS. 3 and 6.

Further, an upper wall 12B of the female receptacle 12 is provided with a resilient locking piece 15 cantilevered rearward from a central part of the front end of the upper wall 12B. The resilient locking piece 15 locks the lever 20 at a connection end position to restrict the rotation of the lever 20.

[Lever 20]

The lever 20 is made of synthetic resin and includes, as shown in FIG. 1, a pair of cam plate portions 21 formed with cam grooves 23 and an operating portion 22 coupling the pair of cam plate portions 21. The lever 20 is a member for pulling the female housing 10 and the male housing 30 toward each other to bring them to a properly connected state by a cam action of the cam grooves 23 and the cam pins 33 as being rotated from an initial position for allowing the entrance of the cam pins 33 into the cam grooves 23 to the connection end position.

Figure 4:
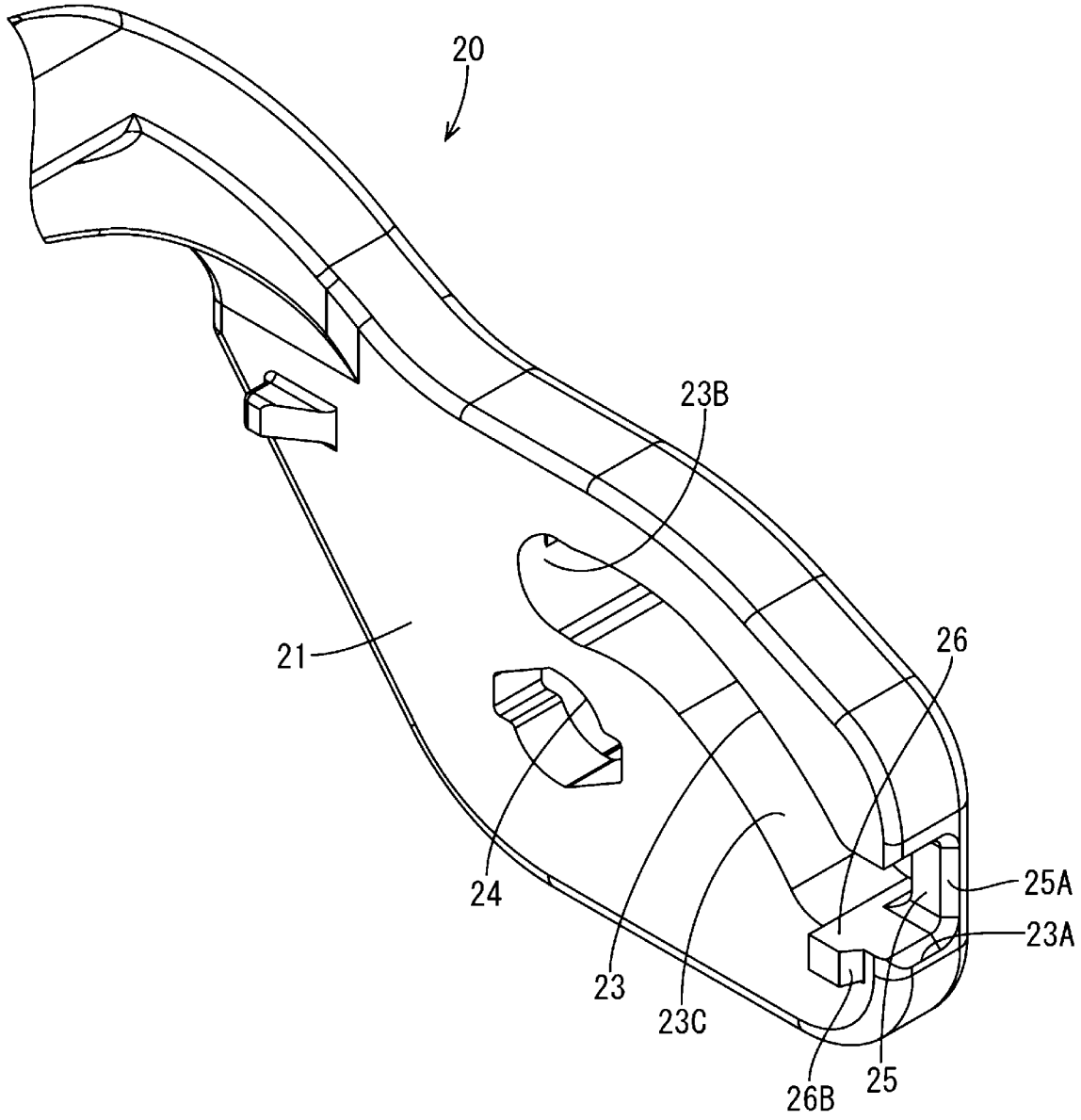
FIG. 4 is a partial enlarged perspective view of the lever of the embodiment.

FIG. 4 is a partial enlarged perspective view of the cam plate portion 21 viewed from inside (side of the female housing 10). As shown in FIGS. 1 and 4, the cam plate portion 21 is provided with a shaft hole 24 through which the support shaft 13 of the female housing 10 is passed. The cam groove 23 includes an entrance 23A open forward when the lever 20 is at the initial position and has an arcuate shape to approach the shaft hole 24 as extending from the entrance 23A toward a back end part 23B. Note that the cam groove 23 linearly extends over a predetermined distance.

As shown in FIG. 4, a coupling portion 25 coupling end parts of facing groove walls of the cam groove 23 on a side opposite to the female housing 10 is provided in the entrance 23A of the cam groove 23 of the lever 20. Out of the coupling portion 25, a corner part on the side of the entrance 23A of the cam groove 23 and on an inner side (side of the female housing 10) is obliquely cut and serves as a lever-side first guiding surface 25A for guiding the entrance of a first pressing portion 36 to be described later to the inner side of the coupling portion 25. Further, the rear surface of the coupling portion 25 located on a side opposite to the entrance 23A of the cam groove 23 serves as a partial connection locking portion 25C extending in a direction perpendicularly intersecting a moving direction of the cam pin 33 (see FIG. 14).

The lever 20 is formed with locking protrusions 26 to be locked into the escaping grooves 14 of the female housing 10. As shown in FIG. 4, the locking protrusion 26 is formed at a position somewhat backward of the entrance 23A of the cam groove 23 toward the back end part 23B. The locking protrusion 26 extends along a groove wall 23C disposed on a lower side of the cam groove 23 and projects inwardly (toward the escaping groove 14) of the female receptacle 12 with the lever 20 disposed at the initial position. A projection dimension of the locking protrusion 26 is about slightly less than half the thickness of the groove wall of the escaping groove 14 as shown in FIG. 6.

The lower surface of the locking protrusion 26 with the lever 20 disposed at the initial position serves as an inclined rotation restricting surface 26A along the lower groove wall 14A of the escaping groove 14 as shown in FIG. 6. The locking protrusion 26 is fit into the escaping groove 14 from an outer surface side. With the lever 20 disposed at the initial position, the rotation restricting surfaces 26A are hooked to the lower groove walls 14A, whereby the lever 20 is held in a state where counterclockwise rotation from the initial position of FIG. 1 is restricted.

Note that the locking protrusion 26 deviates downward in FIG. 6 from an entrance path when the cam pin 33 enters the entrance 23A of the cam groove 23. Thus, the locking protrusion 26 does not interfere with the cam pin 33 having entered the cam groove 23.

Figure 5:
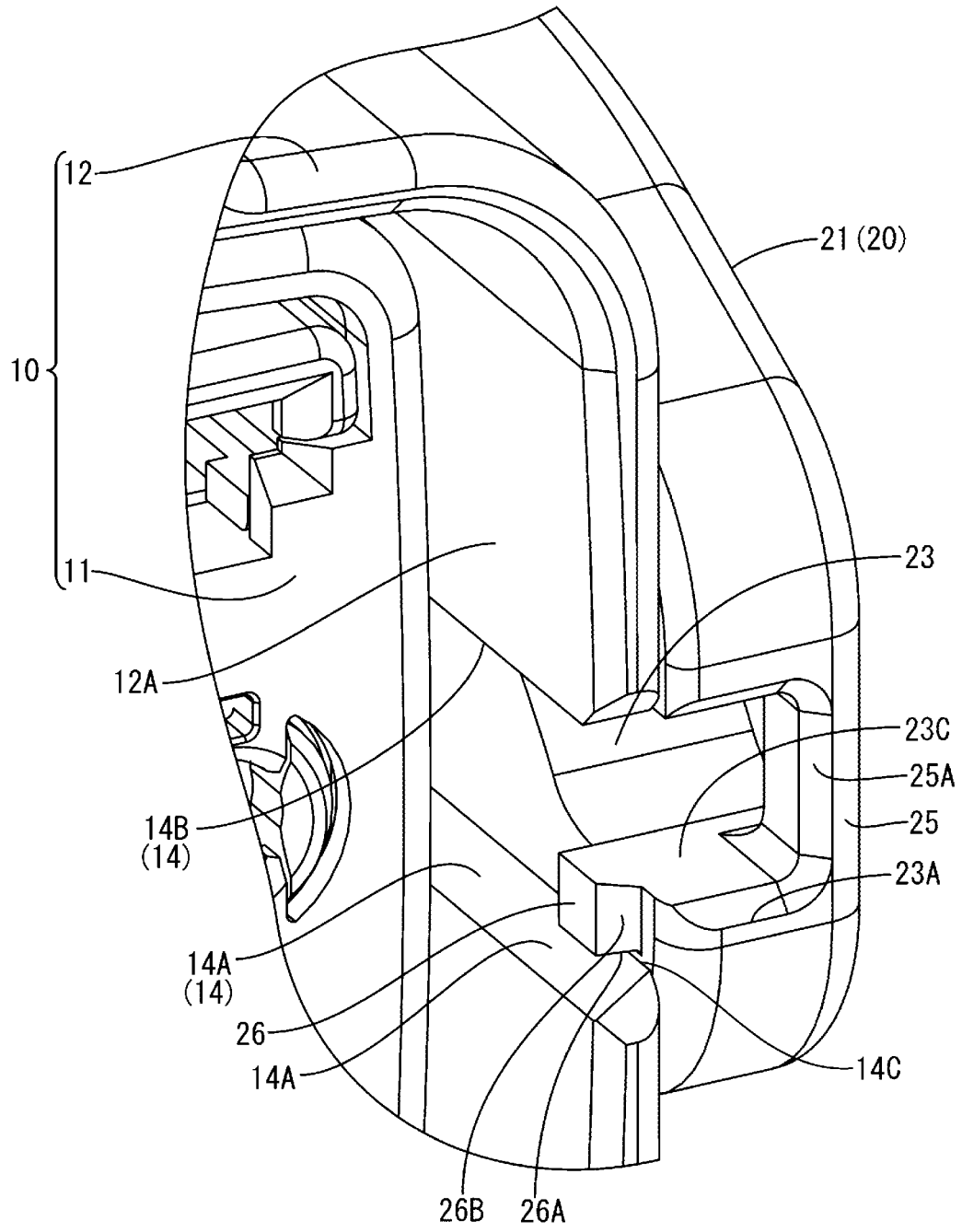
FIG. 5 is a partial enlarged perspective view of the female housing and the lever of the embodiment before connection.
Figure 14:
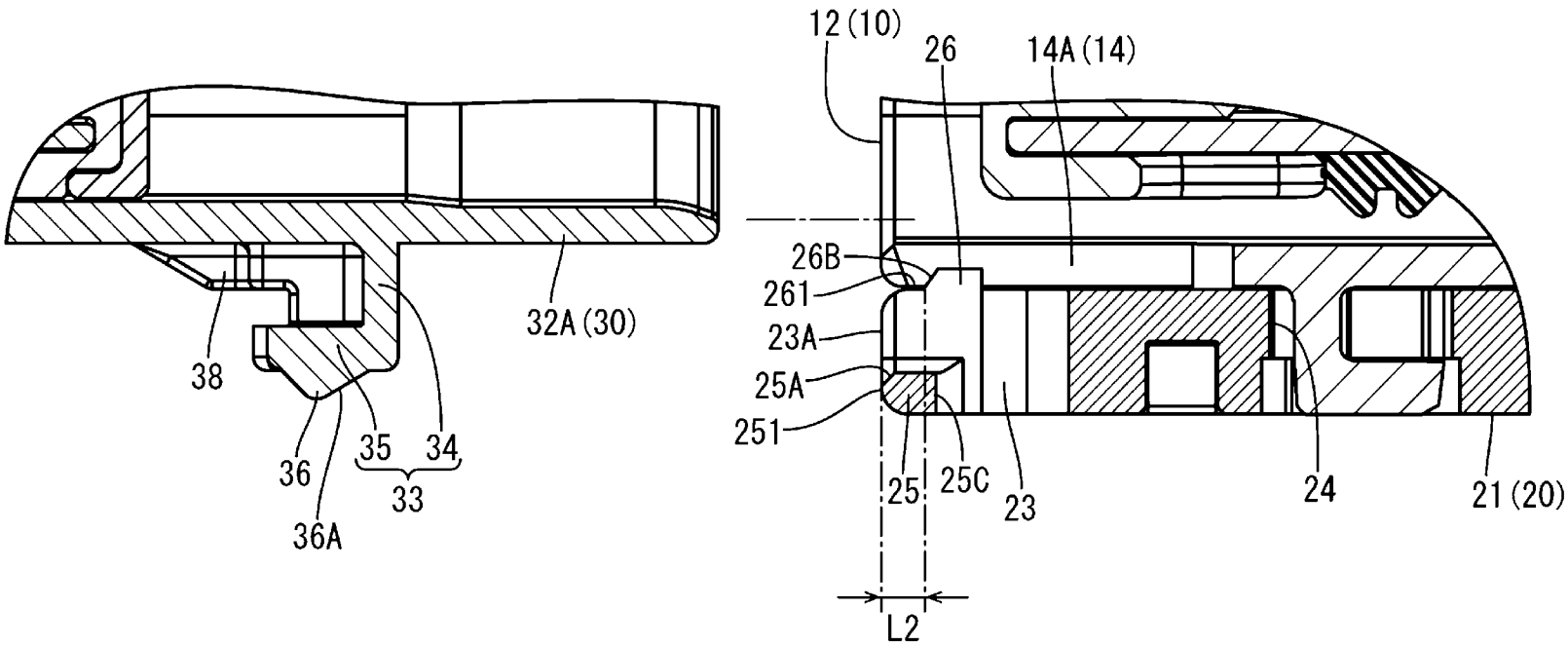
FIG. 14 is a partial enlarged horizontal section of FIG. 2.

As shown in FIGS. 5 and 14, a surface of the locking protrusion 26 disposed on the side of the entrance 23A of the cam groove 23 serves as a lever-side second guiding surface 26B inclined toward the entrance 23A on a base end side. Further, a surface (rear surface) of the locking protrusion 26 facing the lever-side second guiding surface 26B is a surface vertically upright with respect to an extending direction of the cam groove 23.

Further, a groove wall 23D of the cam groove 23 facing the groove wall 23C provided with the locking protrusion 26 (groove wall 23D disposed on an upper side of the cam groove 23 with the lever 20 disposed at the initial position) is stepped entirely in the extending direction of the cam groove 23 (see FIGS. 3 and 6). Specifically, the groove wall 23D includes a step portion 27 in the form of a step protruding inward (downward in FIGS. 3 and 6) in a groove width direction (vertical direction in FIGS. 3 and 6) of the cam groove 23 from the outer surface of the cam plate portion 21 toward an inner surface side.

[Male Housing 30]

The male housing 30 is made of synthetic resin and in the form of a rectangular tube as a whole. As shown in FIG. 2, the male housing 30 includes a male terminal holding portion 31 for holding terminals (not shown) and a male receptacle 32 surrounding the male terminal holding portion 31 and open forward. The terminals held in the male terminal holding portion 31 are, for example, male terminals.

As shown in FIGS. 1 and 2, a pair of the cam pins 33 project on the outer surfaces of left and right side walls 32A of the male receptacle 32. As shown in FIG. 2, the cam pin 33 includes a shaft portion 34 rising outward from the side wall 32A of the male receptacle 32 and a locking portion 35 having an L-shaped cross-sectional shape and projecting rearward from the tip (tip side in a projecting direction) of the shaft portion 34. The locking portion 35 is a part for locking the step portion 27 of the lever 20 described above.

Figure 7:
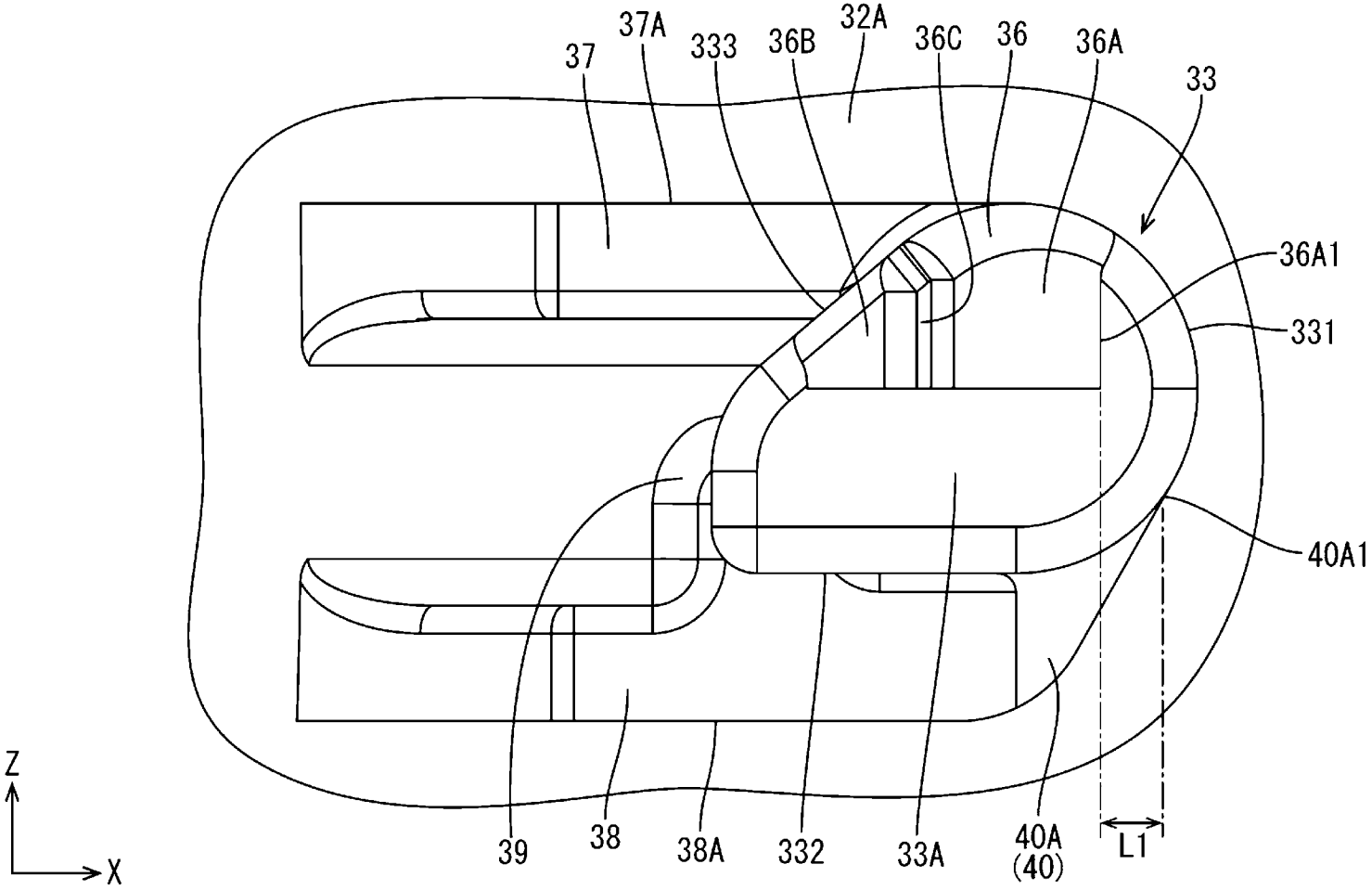
FIG. 7 is a partial enlarged side view of a male housing of the embodiment and a side view of a cam pin.
Figure 8:
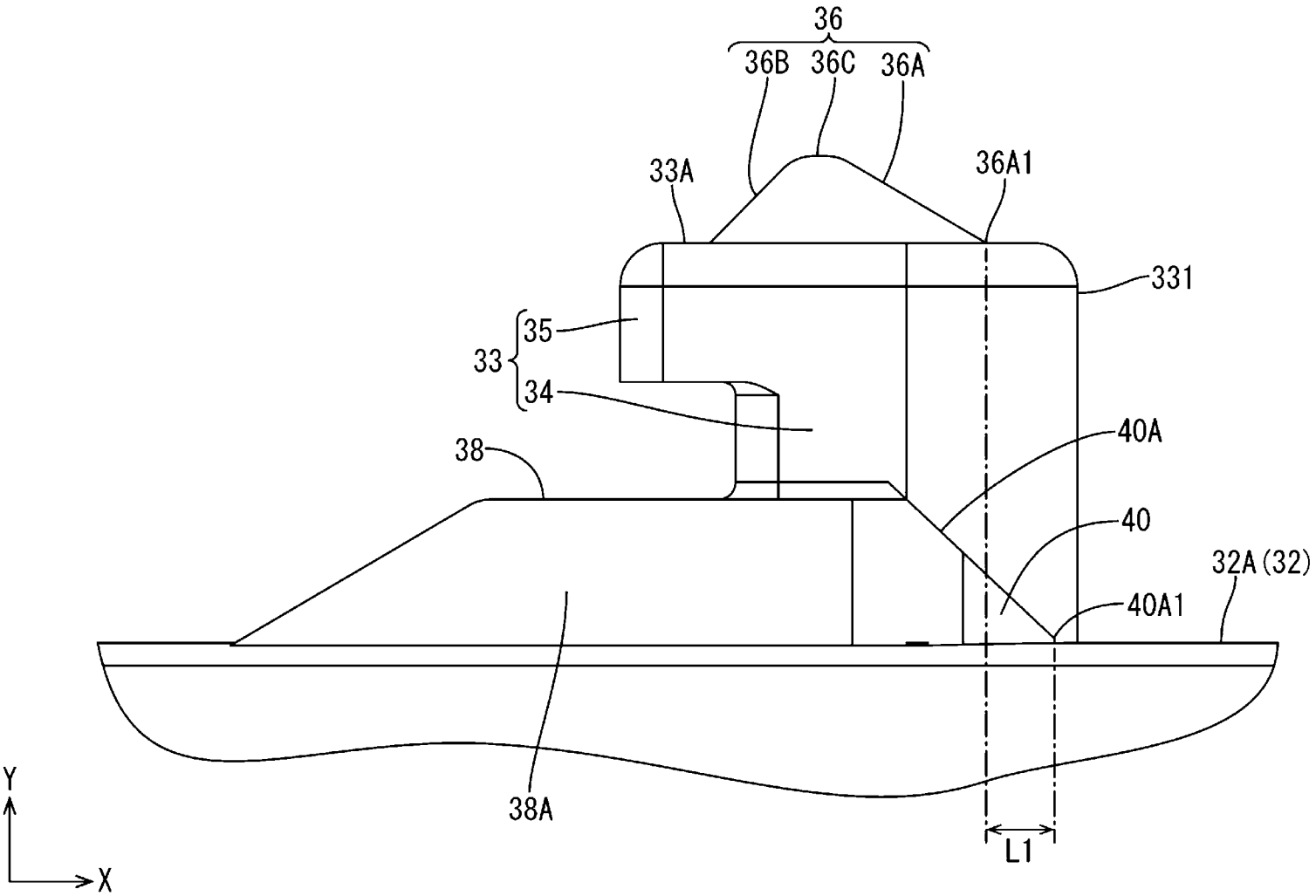
FIG. 8 is a partial enlarged bottom view of the male housing of the embodiment and a bottom view of the cam pin.

FIGS. 7 to 11 are enlarged views of the cam pin 33. Out of these figures, FIG. 7 is a partial enlarged side view of the male housing 30, i.e. shows a view of the cam pin 33 viewed from the side of a tip surface (end surface in the projecting direction) 33A. In the following description, an upper side (Z direction), a lower side, a right side (X direction) and a left side in FIG. 7 are referred to as an upper side, a lower side, a front side and a rear side, and an upper side (Y direction) in FIG. 8 is referred to as a right side.

As shown in FIG. 7, the tip surface 33A of the cam pin 33 has a substantially teardrop shape. Specifically, the tip surface 33A of the cam pin 33 is formed into the substantially teardrop shape by roundly connecting a semicircular first edge part 331 disposed on the front side, a second edge part 332 extending rearward along a connecting direction from the lower end (lower end in FIG. 7) of the first edge part 331 and a third edge part 333 linking the upper end of the first edge part 331 and the rear end of the second edge part 332.

In this embodiment, the first pressing portions 36 for opening the pair of cam plate portions 21 of the lever 20 outward (in directions away from each other) are provided on the tip surfaces 33A of a pair of the cam pins 33.

Figure 11:
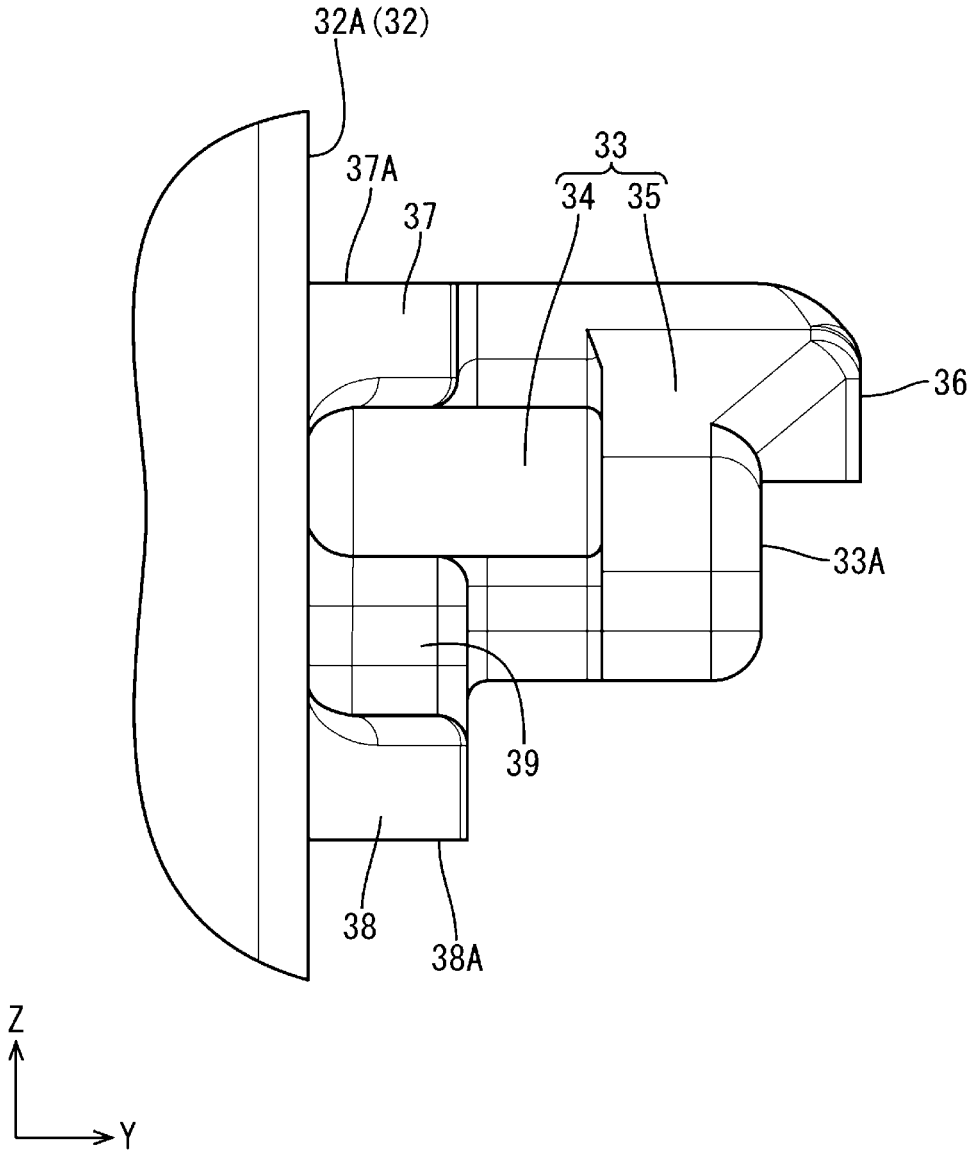
FIG. 11 is a partial enlarged back view of the male housing of the embodiment and a back view of the cam pin.

FIG. 8 is a partial enlarged bottom view of the male housing 30 and shows a view of the cam pin 33 viewed from a bottom side. As shown in FIG. 8, the first pressing portion 36 has a chevron shape projecting from the tip surface 33A of the cam pin 33 toward an outer side (upper side of FIG. 8) of the male housing 30 (male receptacle 32) in the front-rear direction. As shown in FIGS. 7 and 11, this first pressing portion 36 is provided on an upper part of the tip surface 33A of the cam pin 33. Out of the first pressing portion 36, an inclined surface disposed on a front side is referred to as a male housing-side first guiding surface 36A, a slope disposed on a rear side is referred to as a rear slope 36B and a projecting end part is referred to as a top part 36C below. A front end 36A1 (right end part in FIGS. 7 and 8) of the male housing-side first guiding surface 36A is located somewhat rearward of the front end of the first edge part 331 of the cam pin 33.

Out of a base end part of the shaft portion 34 of the cam pin 33, a part disposed on an upper side in FIG. 7 is formed with an upper rib 37 extending rearward. The upper rib 37 is shaped to perpendicularly rise from the outer surface of the side wall 32A of the male receptacle 32 (see FIG. 9). The upper rib 37 is so fit that an upper surface 37A (surface disposed on the upper side in FIG. 7) thereof slides on the upper groove wall 14B of the escaping groove 14 of the female housing 10.

Further, a lower rib 38 protruding below the shaft portion 34 and extending in the front-rear direction is formed on a side lower than the base end part of the shaft portion 34 of the cam pin 33 in FIG. 7. The lower rib 38 is shaped to perpendicularly rise from the outer surface of the side wall 32A of the male receptacle 32 (see FIGS. 8 and 10). A rising height of the lower rib 38 from the side wall 32A of the male receptacle 32 is equal to that of the upper rib 37 from the side wall 32A of the male receptacle 32. Further, the rising height of the lower rib 38 is slightly larger than a height of the groove wall 14A of the escaping groove 14 of the female housing 10 (plate thickness of the side wall 12A of the female receptacle 12) (see FIG. 23). A lower surface 38A (surface disposed on the lower side in FIG. 7) of the lower rib 38 is fit inside the lower groove wall 14A of the escaping groove 14 of the female housing 10.

A front part of this lower rib 38 serves as a second pressing portion 40 for releasing the locking of the locking protrusion 26 with the escaping groove 14. The second pressing portion 40 is a part which comes into contact with the locking protrusion 26 to push the locking protrusion 26 outward from the escaping groove 14 when the male housing 30 is connected to the female housing 10. This second pressing portion 40 has a male housing-side second guiding surface 40A on a front end. The male housing-side second guiding surface 40A is inclined to approach the side wall 32A of the male receptacle 32 toward the front side as shown in FIG. 8. Further, the male housing-side second guiding surface 40A is formed into a substantially triangular shape by cutting a corner part between the front end and the lower end in a side view of the male housing 30 (see FIGS. 7 and 10).

Figure 9:
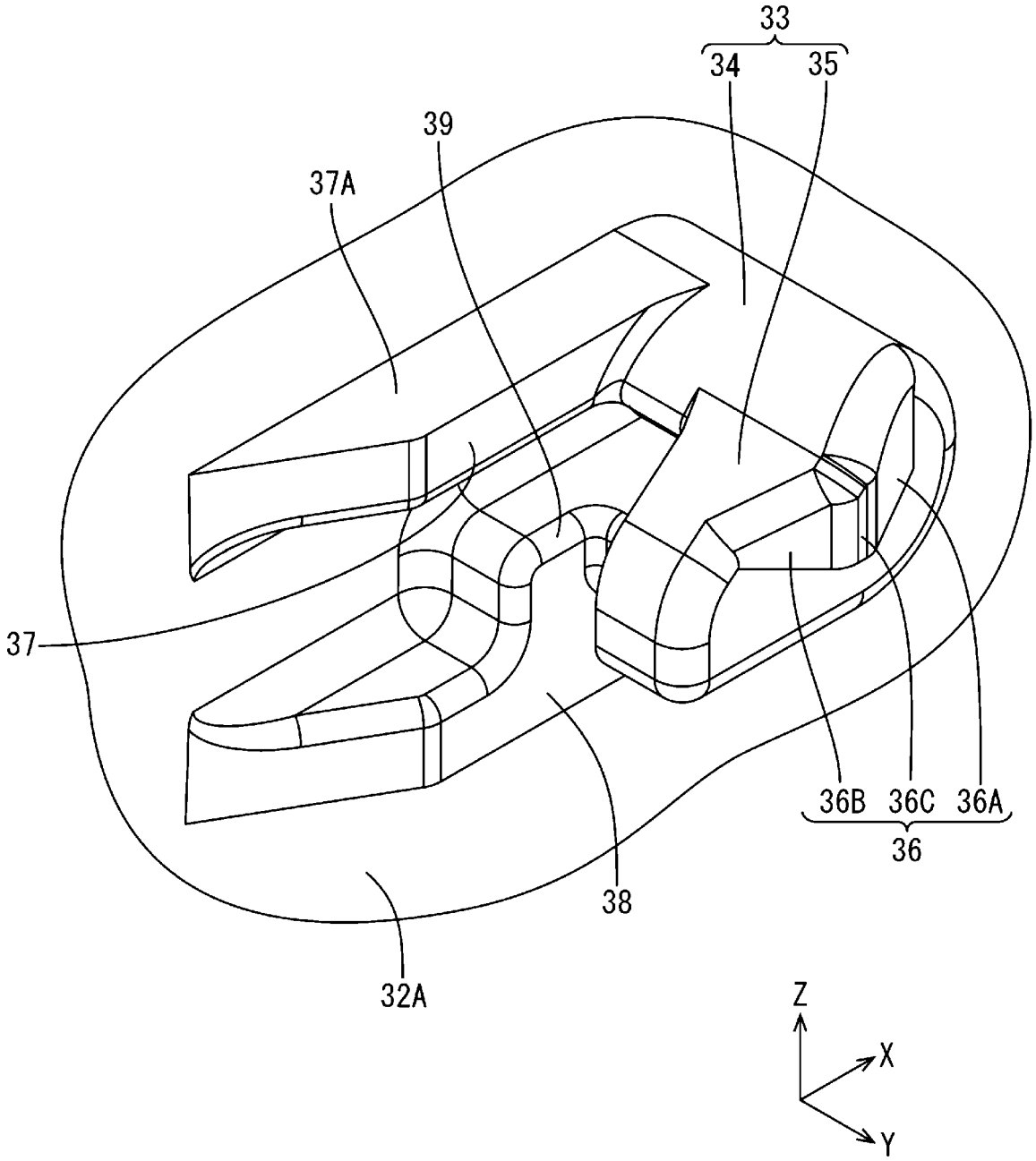
FIG. 9 is a partial enlarged perspective view of the male housing of the embodiment and a perspective view of the cam pin viewed obliquely from above.
Figure 10:
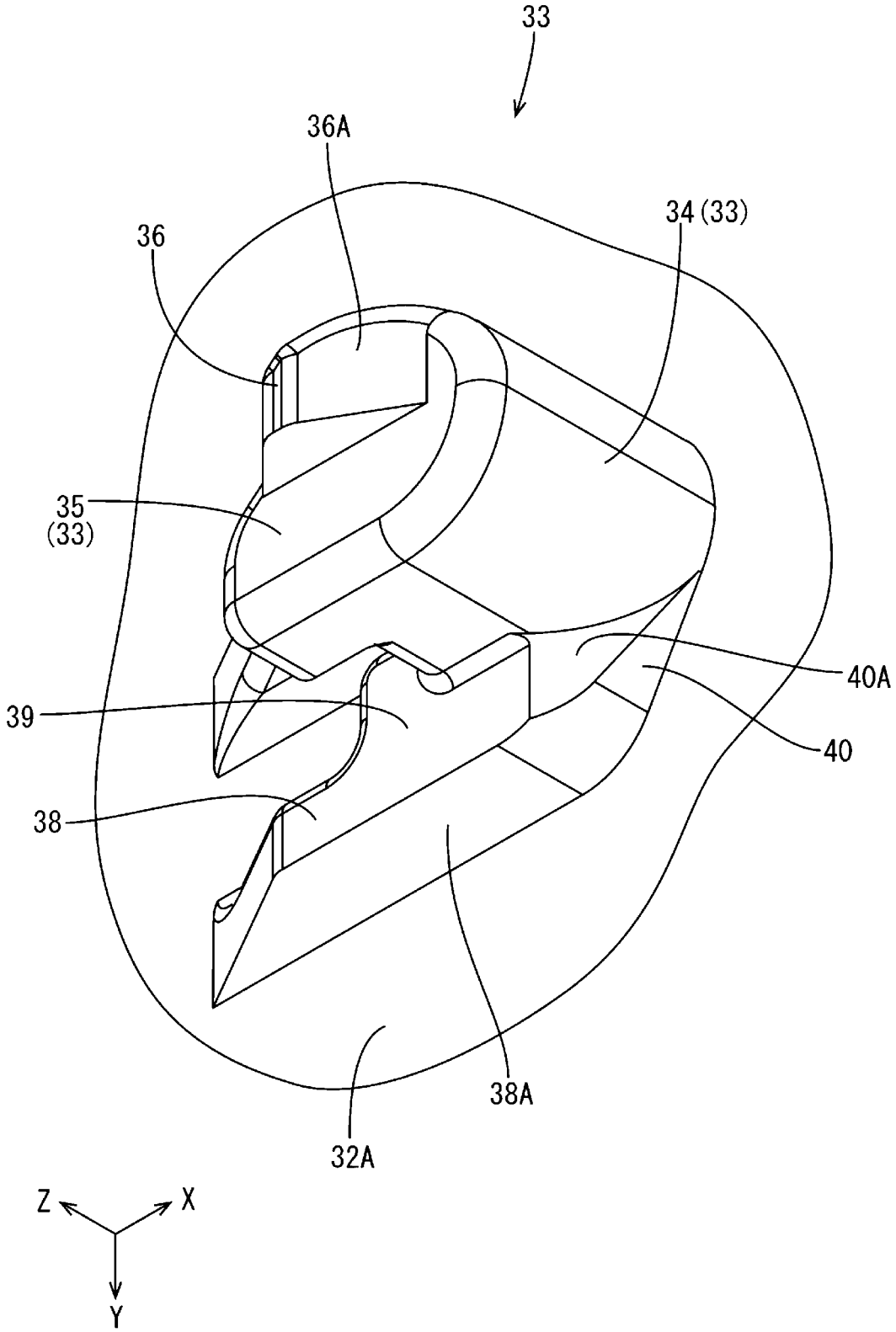
FIG. 10 is a partial enlarged perspective view of the male housing of the embodiment and a perspective view of the cam pin viewed obliquely from below.

Further, the lower rib 38 is provided with a reinforcing portion 39 projecting upward and continuous with the rear surface of the shaft portion 34 of the cam pin 33. Further, rear parts of the upper and lower ribs 37, 38 are inclined to approach the side wall 32A of the male receptacle 32 toward the rear side (FIGS. 8 to 10).

The male housing-side first guiding surface 36A of the first pressing portion 36 and the male housing-side second guiding surface 40A of the second pressing portion 40 are disposed at positions different in the front-rear direction. Specifically, as shown in FIGS. 7 and 8, a front end 40A1 of the male housing-side second guiding surface 40A is located slightly forward of the front end 36A1 of the male housing-side first guiding surface 36A. However, a distance L1 between the front end 36A1 of the male housing-side first guiding surface 36A and the front end 40A1 of the male housing-side second guiding surface 40A is set shorter than a distance L2 (see FIG. 14) from a front end 251 of the coupling portion 25 of the lever 20 disposed at the initial position to a front end 261 of the locking protrusion 26. In this way, in a connection initial stage of the female housing 10 and the male housing 30, the male housing-side first guiding surface 36A first comes into contact with the coupling portion 25 of the lever 20 and, thereafter, the male housing-side second guiding surface 40A comes into contact with the locking protrusion 26.

Note that the aforementioned rising heights of the upper and lower ribs 37, 38 are set shorter than heights of the locking portions 35 of the cam pins 33 from the side walls 32A (see FIG. 8) and set such that the upper and lower ribs 37, 38 slightly project from the outer surface of the female receptacle 12 when the upper and lower ribs 37, 38 are fit into the escaping groove 14 of the female receptacle 12. Further, the locking portion 35 of the cam pin 33 is set at such a height position from the side wall 32A of the male receptacle 32 that the locking portion 35 slides in contact with the step portion 27 formed in the cam groove 23 when the cam pin 33 is fit into the escaping groove 14.

This embodiment is configured as described above. Next, a connecting operation of the female housing 10 and the male housing 30 is described. As shown in FIGS. 1 to 3, the lever 20 is mounted at the initial position on the female housing 10. At this time, the locking protrusions 26 of the lever 20 are fit into the escaping grooves 14 from the outer surface sides of the female housing 10 (female receptacle 12) and the rotation restricting surfaces 26A are locked to the lower groove walls 14A of the escaping grooves 14, whereby the lever 20 is held in a rotation restricted state from the initial position (see FIGS. 5 and 6). Since the lever 20 is at the initial position, the entrances 23A of the cam grooves 23 are open forward.

Figure 12:
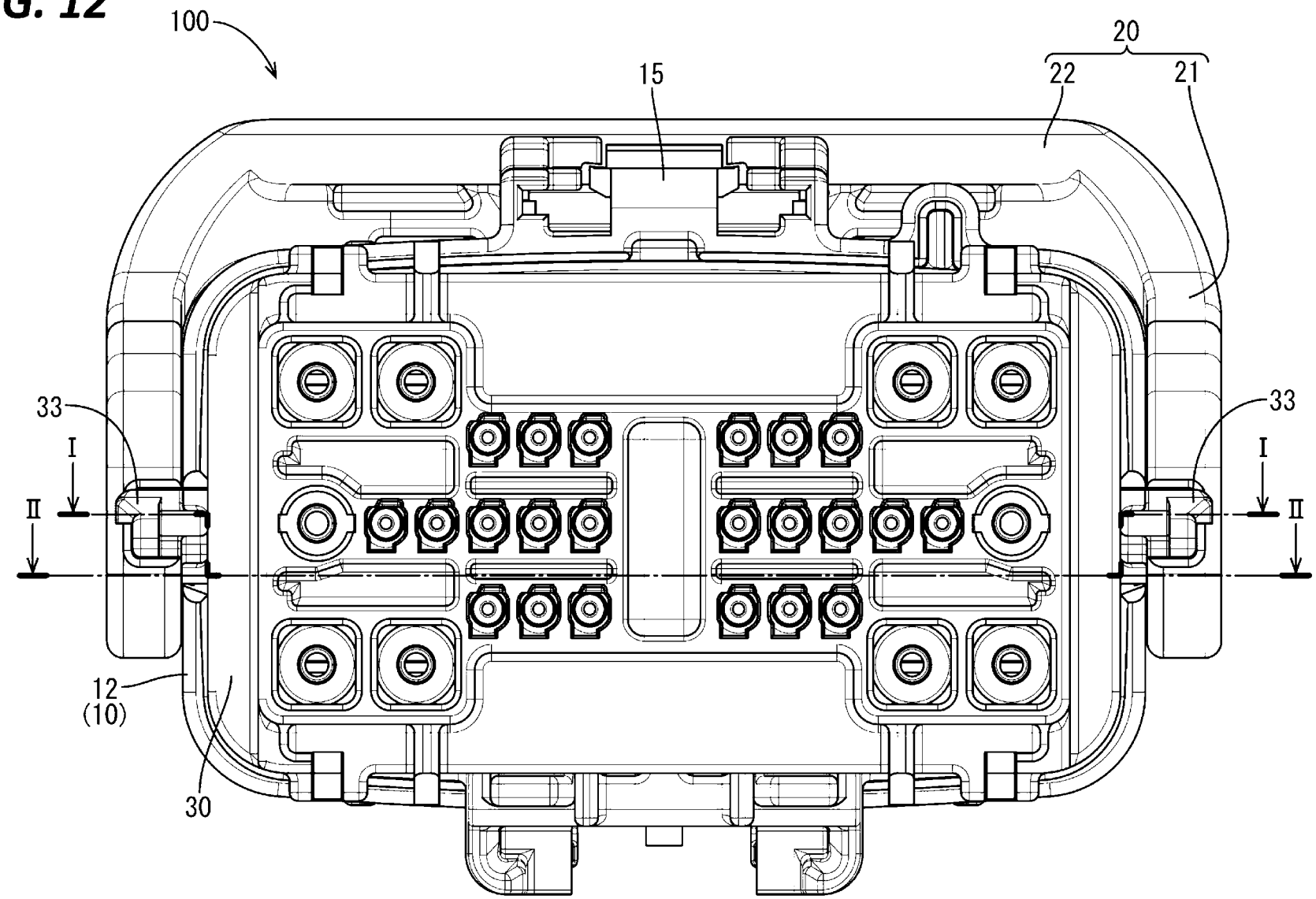
FIG. 12 is a view of the lever-type connector of the embodiment before connection when viewed from a back surface side of the male housing.

FIG. 12 is a view of the female housing 10 and the male housing 30 immediately before connection when viewed from the back surface side of the male housing 30. In FIG. 12, a part of the female housing 10 arranged on a back side and the lever 20 assembled with the female housing 10 are seen.

Figure 13:
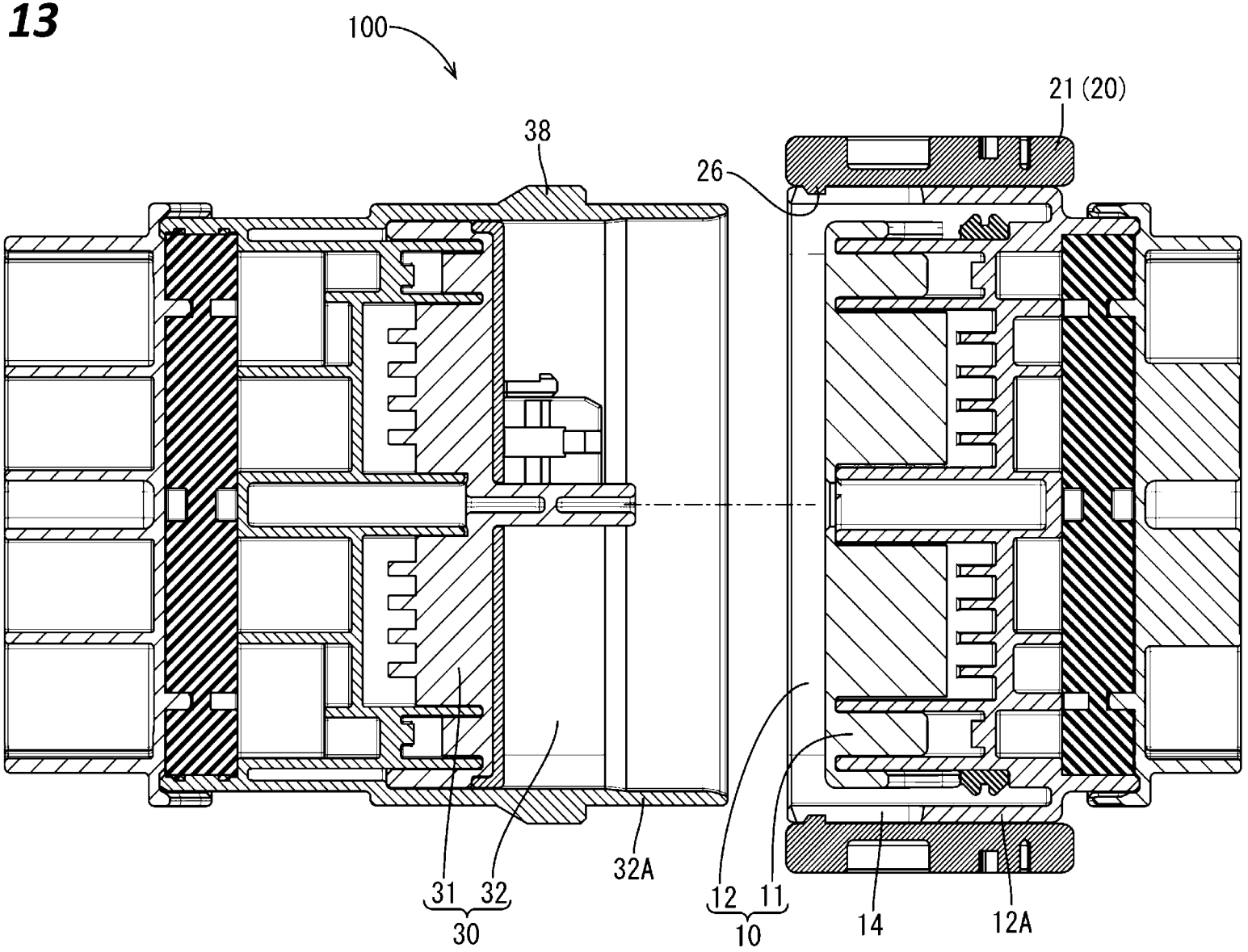
FIG. 13 is a horizontal section of the lever-type connector of the embodiment before connection.
Figure 15:
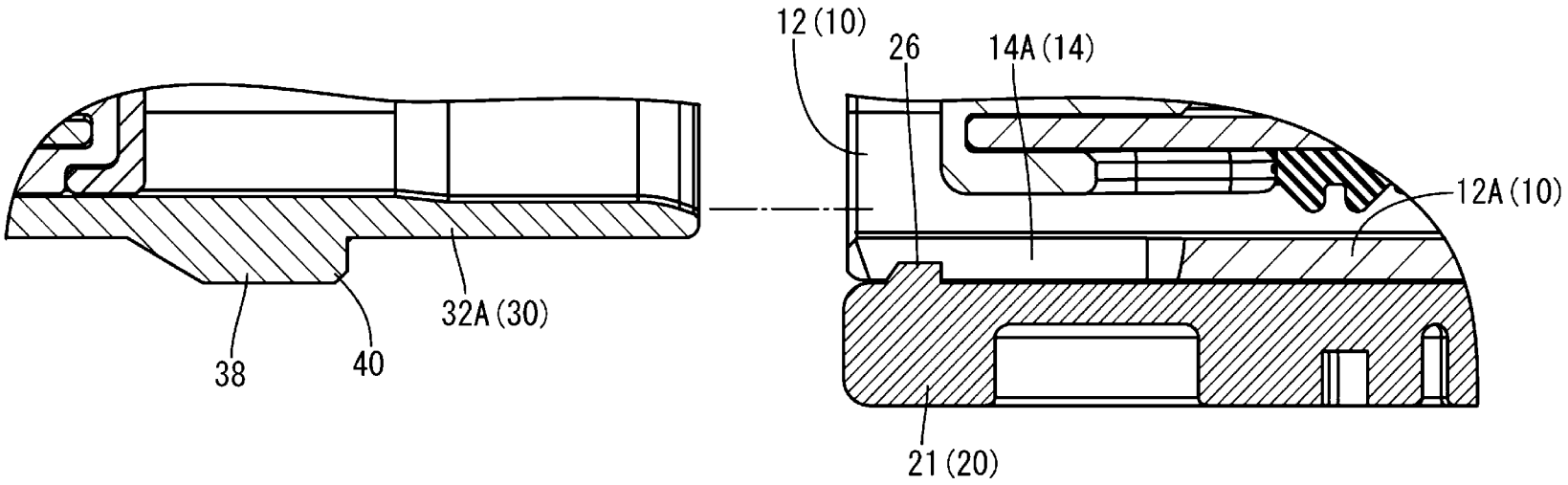
FIG. 15 is a partial enlarged horizontal section of FIG. 13.

FIG. 13 is a section along II-II of FIG. 12, i.e. a horizontal section of the female housing 10 and the male housing 30 immediately before the connection. In FIG. 13, cross-sections of the second pressing portions 40 and the lower ribs 38 and cross-sections of the locking protrusions 26 are seen. Note that FIG. 2 described above is a section along I-I of FIG. 12 and shows cross-sections of the cam pins 33, the upper surfaces of the locking protrusions 26, cross-sections of the coupling portions 25 and the like. Further, FIG. 14 is an enlarged horizontal section of an essential part of FIG. 2, and FIG. 15 is an enlarged horizontal section of an essential part of FIG. 13.

Figure 16:
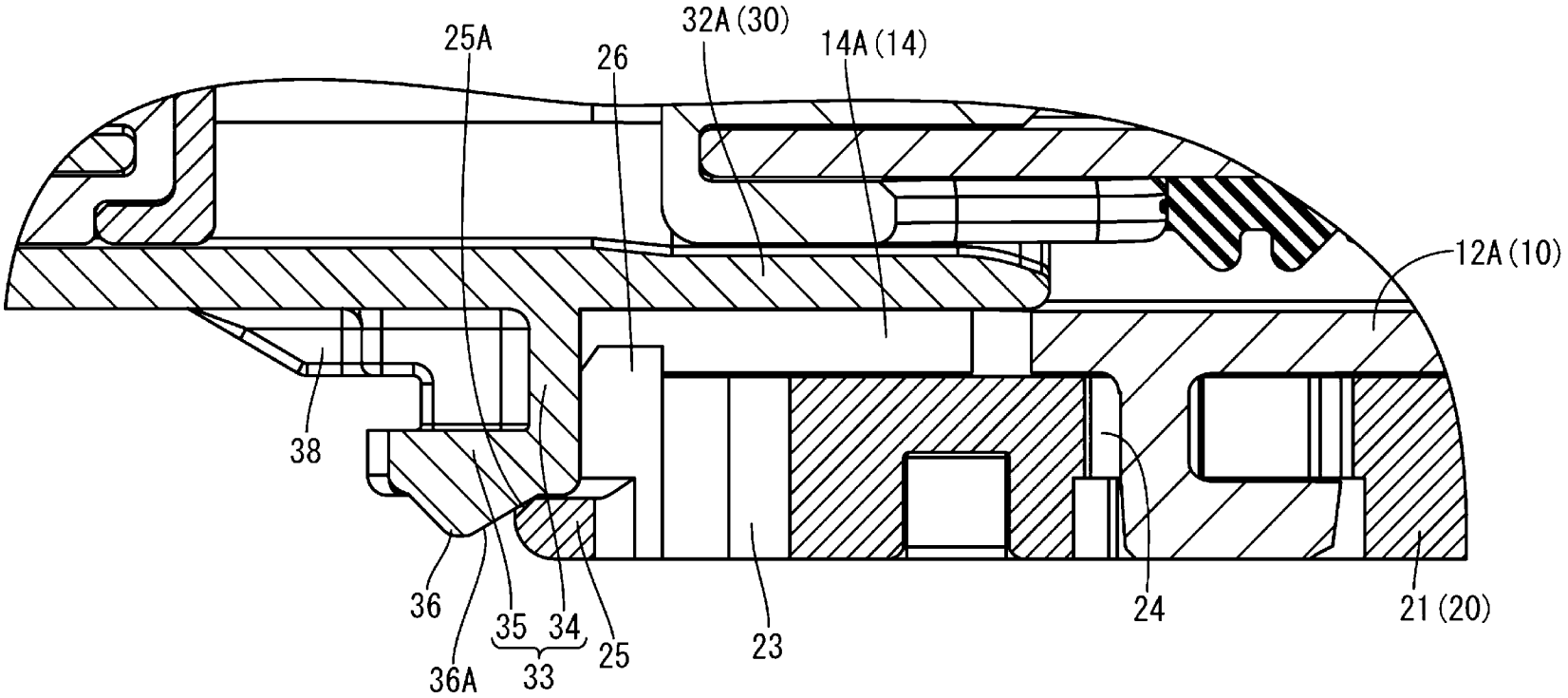
FIG. 16 is a partial enlarged horizontal section showing a state where connection proceeds from a state of FIG. 14 and a first pressing portion is in contact with a coupling portion.

With the lever 20 held at the initial position, the female housing 10 and the male housing 30 are shallowly fit. Then, as shown in FIG. 16, the first pressing portions 36 provided on the tip surfaces of the cam pins 33 come into contact with the coupling portions 25 provided in the entrances 23A of the cam grooves 23 of the lever 20 and press inner sides of the pair of coupling portions 25, thereby gradually pushing the cam plate portions 21 more outward, as the cam pins 33 enter the entrances 23A of the cam grooves 23.

At this time, the first pressing portion 36 is provided with the male housing-side first guiding surface 36A, and the coupling portion 25 is provided with the lever-side first guiding surface 25A. Accordingly, the first pressing portion 36 smoothly enters the coupling portion 25 and the slopes slide in contact with each other, whereby a stress applied to contact portions is dispersed. The pair of cam plate portions 21 are gently pushed wider apart by the first pressing portions 36.

Figure 17:
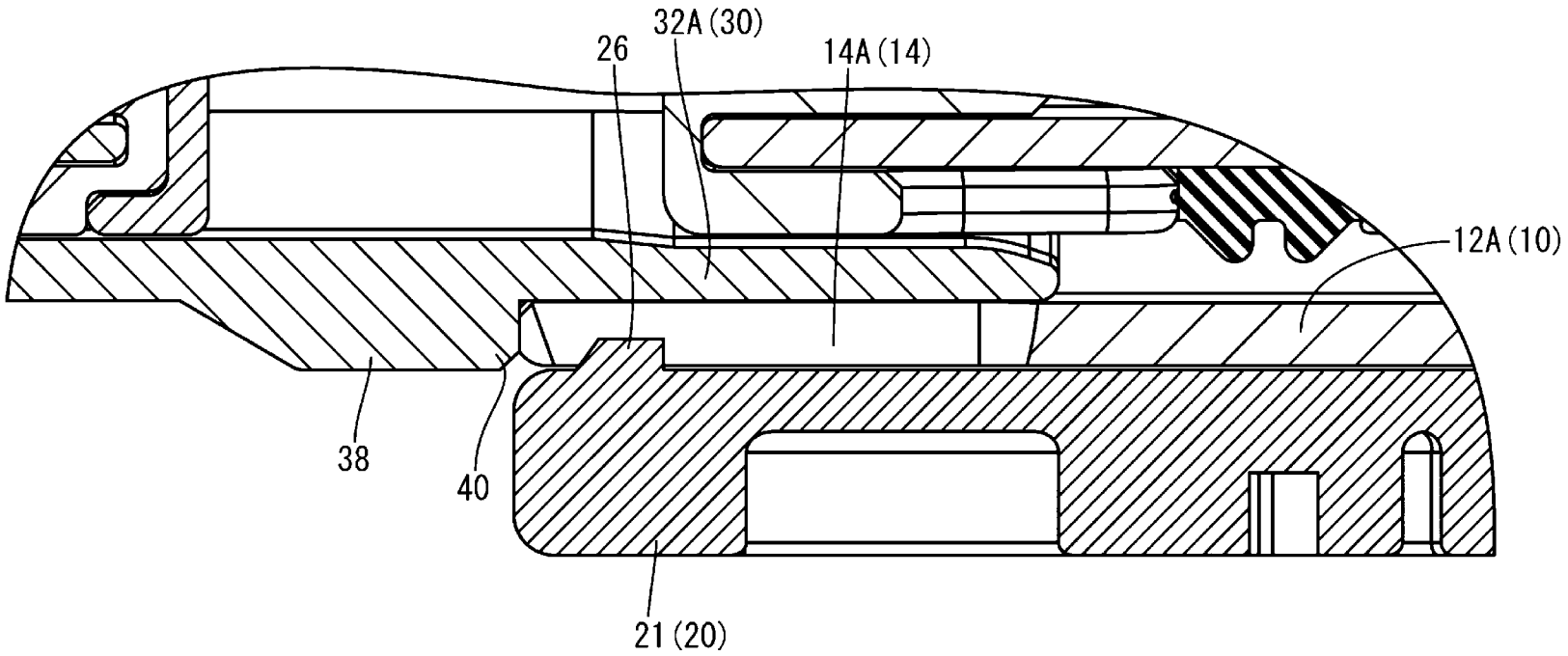
FIG. 17 is a partial enlarged horizontal section showing a state of a second pressing portion and a locking protrusion at the same point of time as in FIG. 16 after the connection proceeds from a state of FIG. 15.

Note that when the first pressing portion 36 comes into contact with the coupling portion 25, the second pressing portion 40 has not reached the locking protrusion 26 yet as shown in FIG. 17. Further, the locking protrusion 26 is disposed in the escaping groove 14 and the rotation restricted state of the lever 20 is not released yet.

Figure 20:
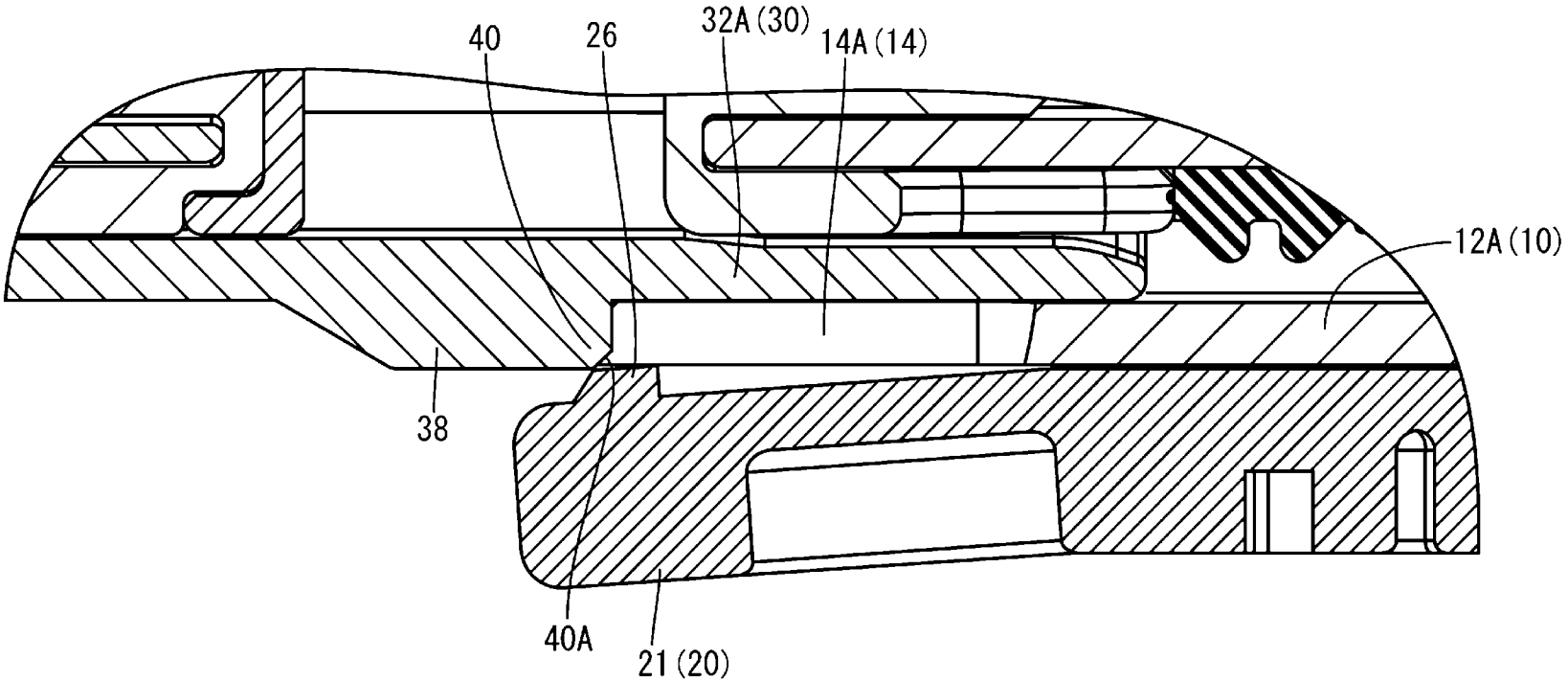
FIG. 20 is a partial enlarged horizontal section showing a state of the second pressing portion and the locking protrusion at the same point of time as in FIG. 18 after the connection proceeds from the state of FIG. 17.

If the both housings 10, 30 are pushed and connected further, the second pressing portions 40 of the male housing 30 come into contact with the locking protrusions 26 of the lever 20 in a state where the first pressing portions 36 are riding on the coupling portions 25, i.e. in a state where the lever 20 is opened outward (see FIG. 20).

Figure 18:
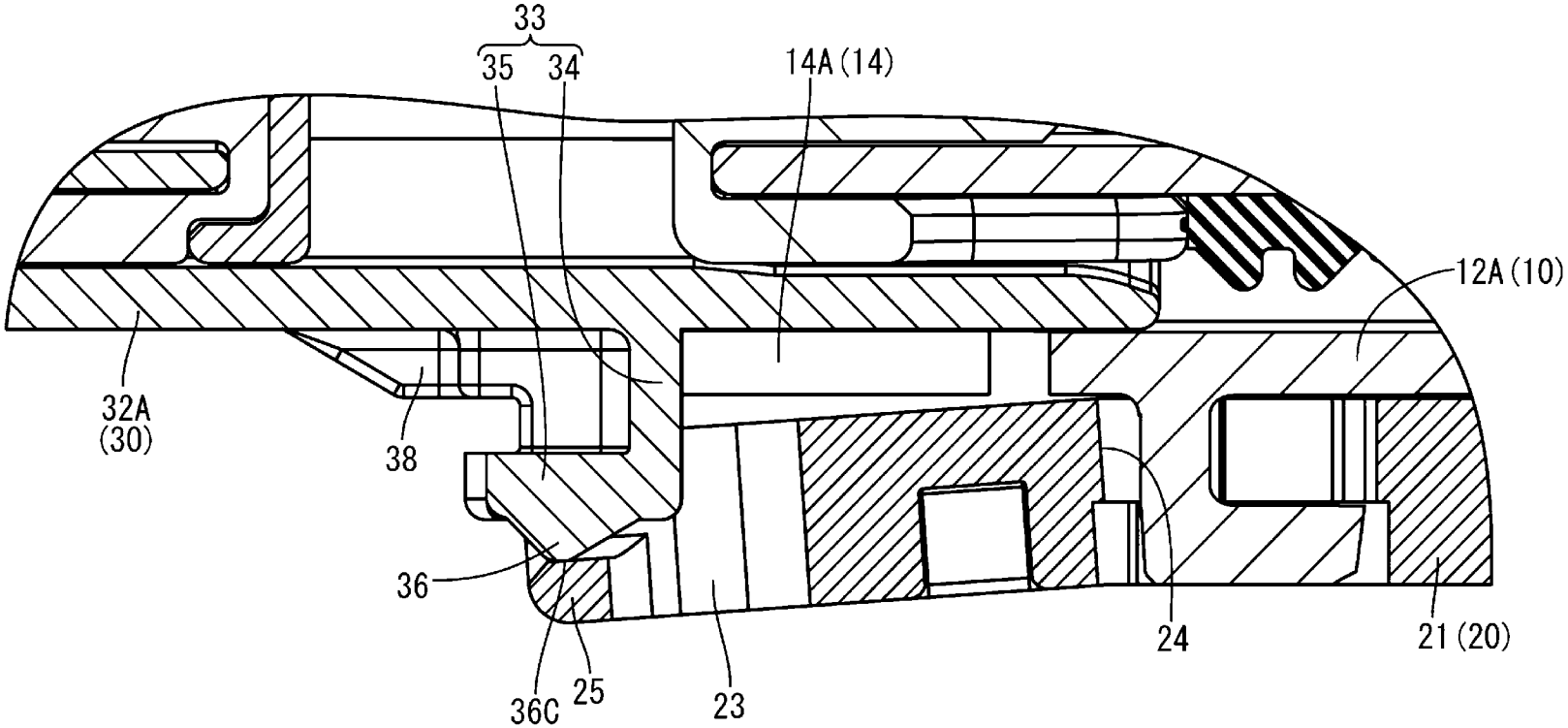
FIG. 18 is a partial enlarged horizontal section showing a state where the connection proceeds from the state of FIG. 16 and the first pressing portion is pressing the coupling portion.
Figure 19:
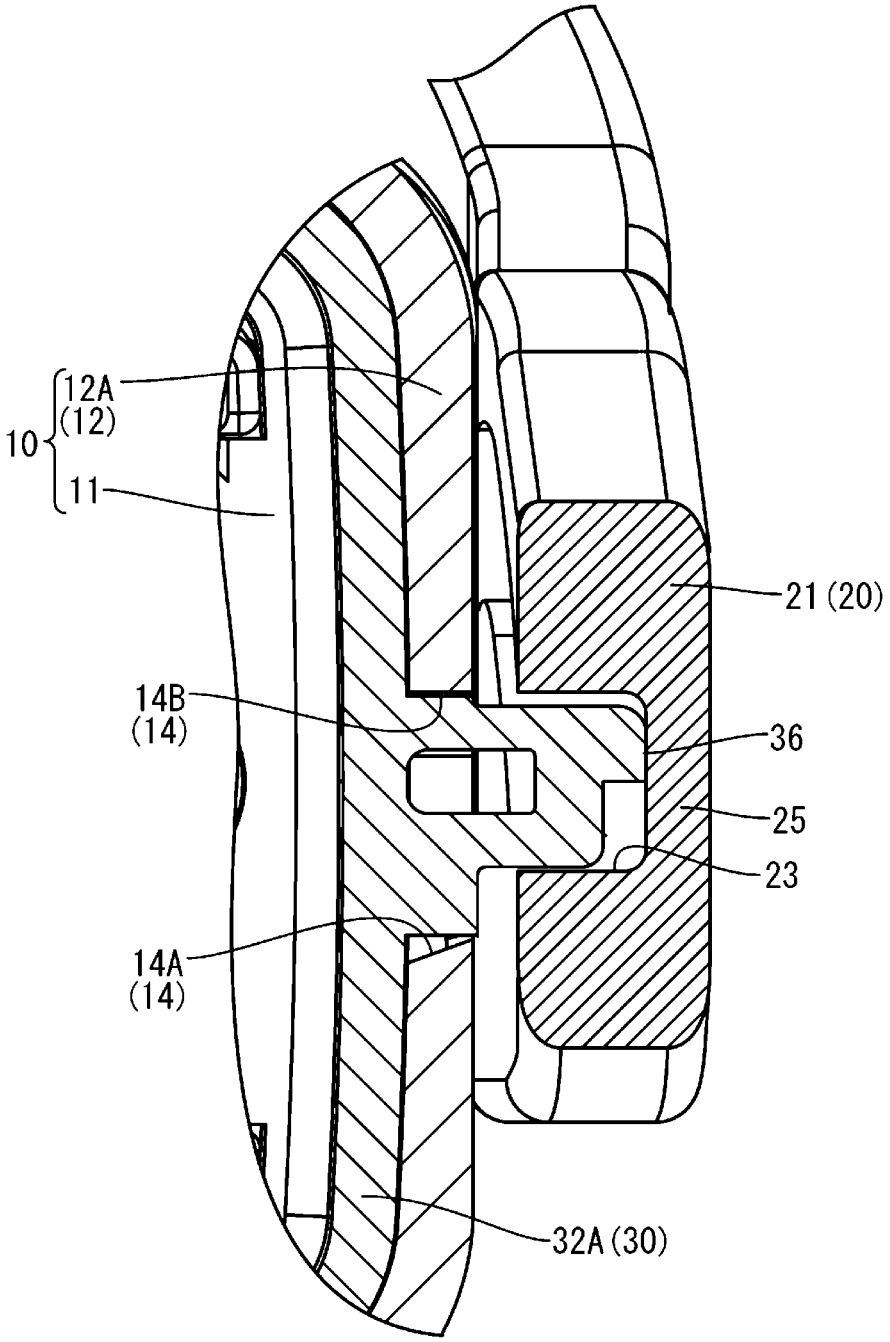
FIG. 19 is a partial enlarged vertical section of the lever-type connector of the embodiment at the same point of time as in FIG. 18.

In this embodiment, the top part 36C of the first pressing portion 36 is in contact with the inner surface of the coupling portion 25 when the second pressing portion 40 comes into contact with the locking protrusion 26 (see FIGS. 18 and 19). Further, at this point of time, the cam plate portion 21 is deformed up to a position where the locking protrusion 26 is just pushed out from the escaping groove 14 outwardly of the female receptacle 12 (see FIGS. 20 and 21). Accordingly, it is suppressed that a large force is applied to the locking protrusion 26 and the second pressing portion 40 in contact with each other. Further, at this point of time, the cam plate portion 21 is deformed up to a position where a corner part of the rear end of the male housing-side second guiding surface 40A of the second pressing portion 40 comes into contact with a corner part of the locking protrusion 26 on the side of the entrance 23A (see FIG. 20).

Figure 21:
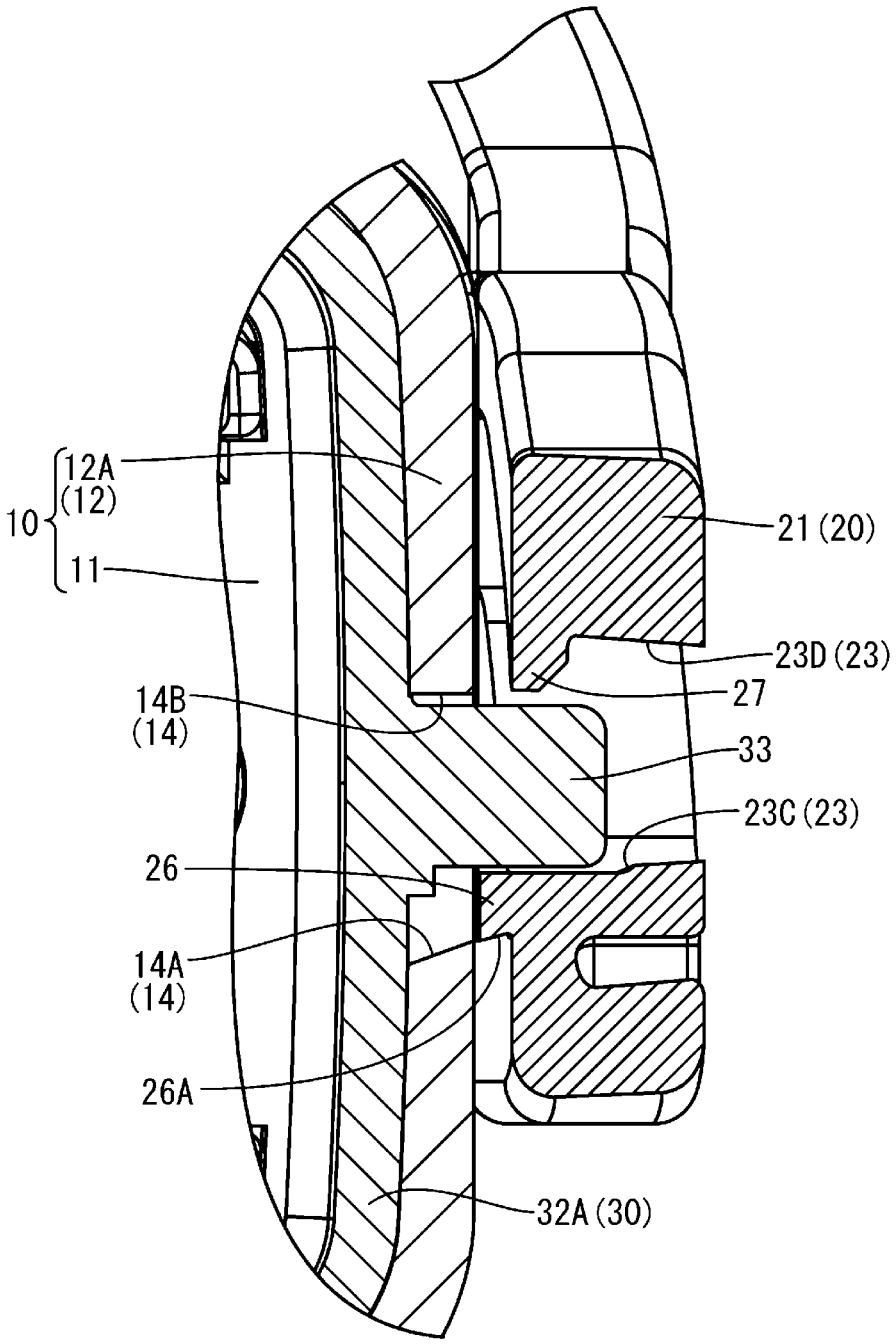
FIG. 21 is partial enlarged vertical section of the lever-type connector of the embodiment at a position different from that of FIG. 2 at the same point of time as in FIG. 18.

Further, when the second pressing portion 40 comes into contact with the locking protrusion 26, the locking protrusion 26 is pushed out from the escaping groove 14 as described above, whereby the rotation restricted state of the lever 20 is released (see FIGS. 20 and 21).

Note that FIG. 19 is a vertical section cut at a part where the first pressing portion 36 of the male housing 30 and the coupling portion 25 of the lever 20 are in contact, and FIG. 21 is a vertical section cut at a part including a projecting end of the locking protrusion 26 of the lever 20. FIGS. 19 and 21 are vertical sections cut at the same point of time.

Figure 22:
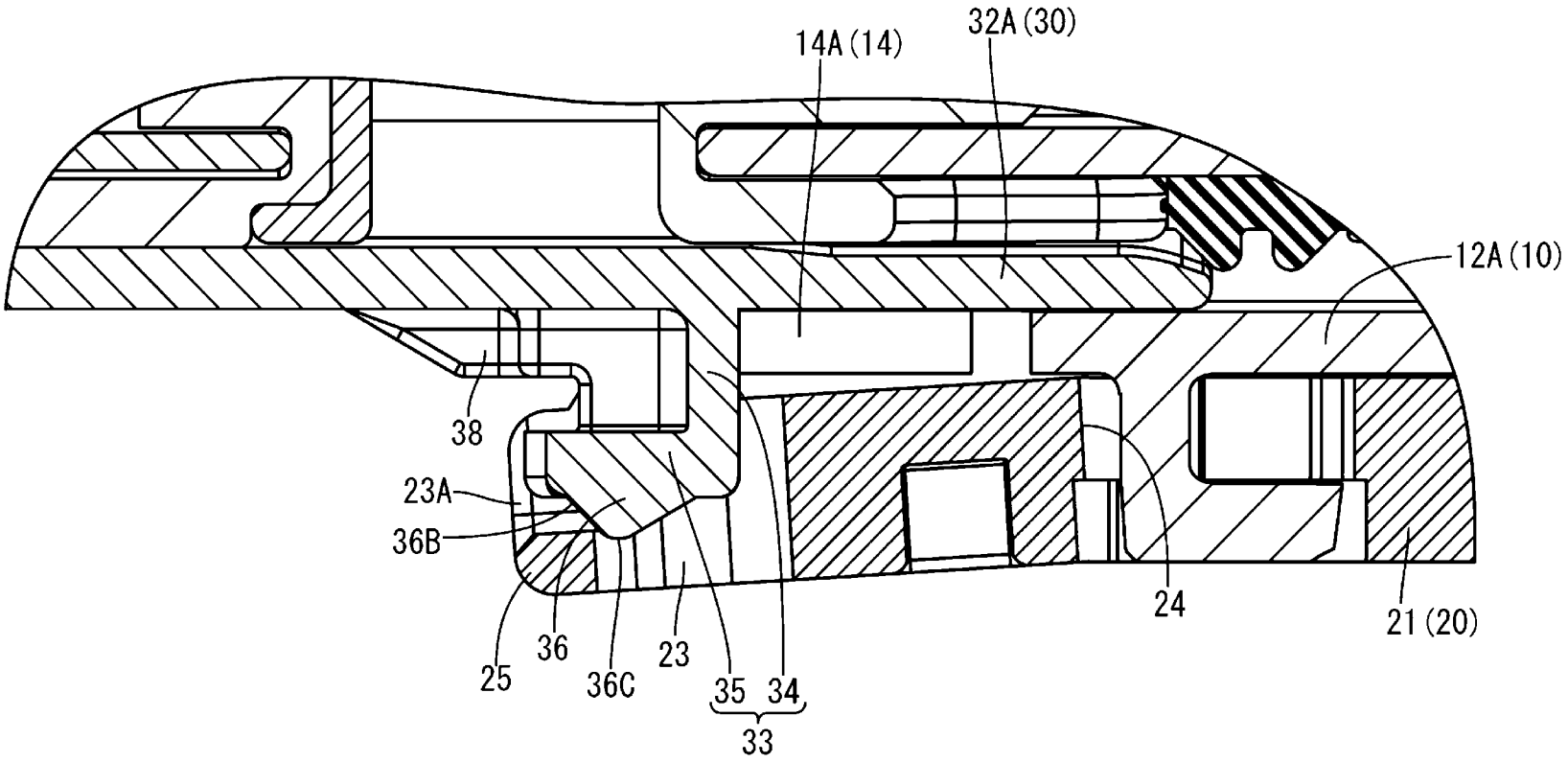
FIG. 22 is a partial enlarged horizontal section showing a state where the connection proceeds from the state of FIG. 18 and the first pressing portion pass the coupling portion.

If the lever 20 is rotated after the rotation restriction of the lever 20 is released, the coupling portion 25 rides over the top part 36C of the first pressing portion 36 as shown in FIG. 22 and, thereafter, moves along the rear slope 36B, whereby the pressing (deformation) of the cam plate portion 21 by the first pressing portion 36 is gradually released.

Figure 23:
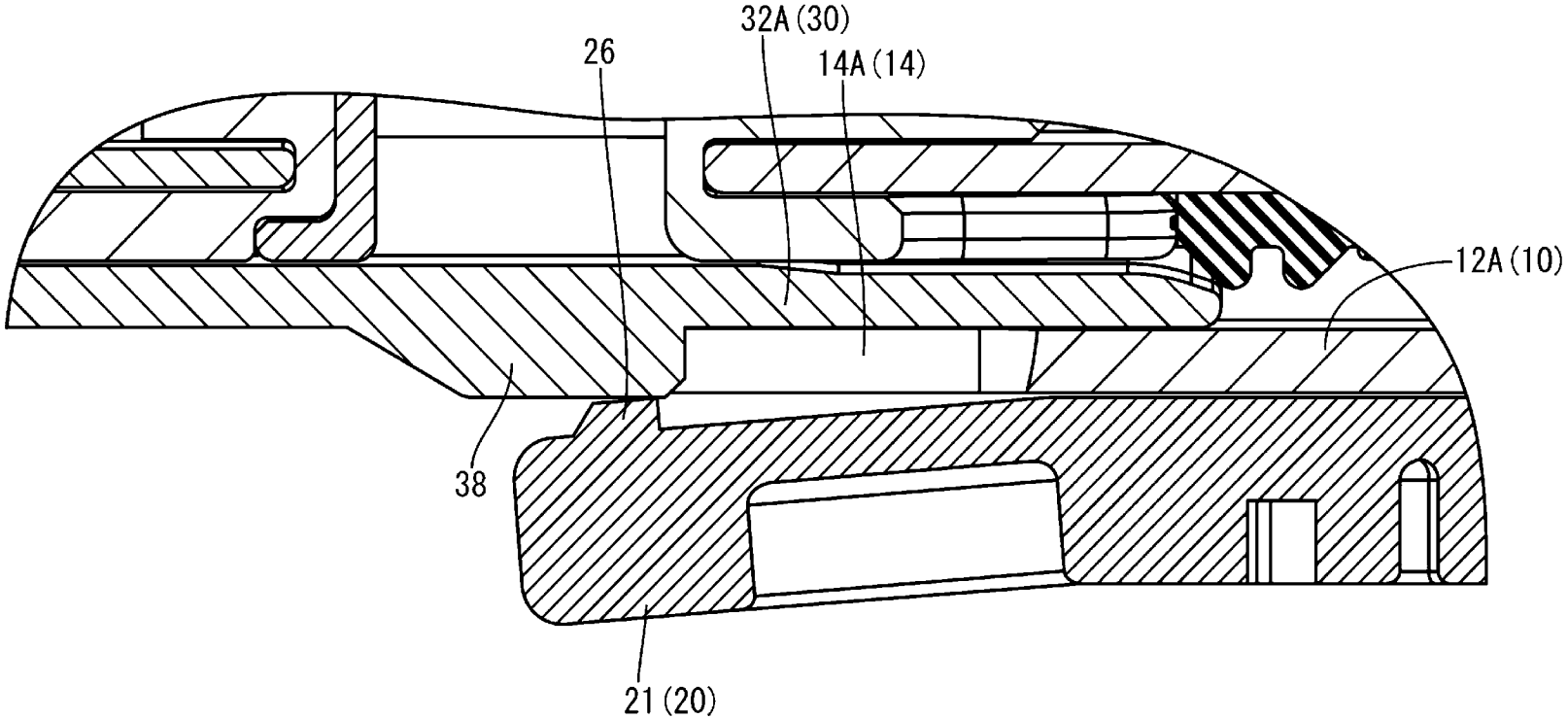
FIG. 23 is a partial enlarged horizontal section showing a state of a lower rib and the locking protrusion at the same point of time as in FIG. 22 after the connection proceeds from the state of FIG. 20.
Figure 24:
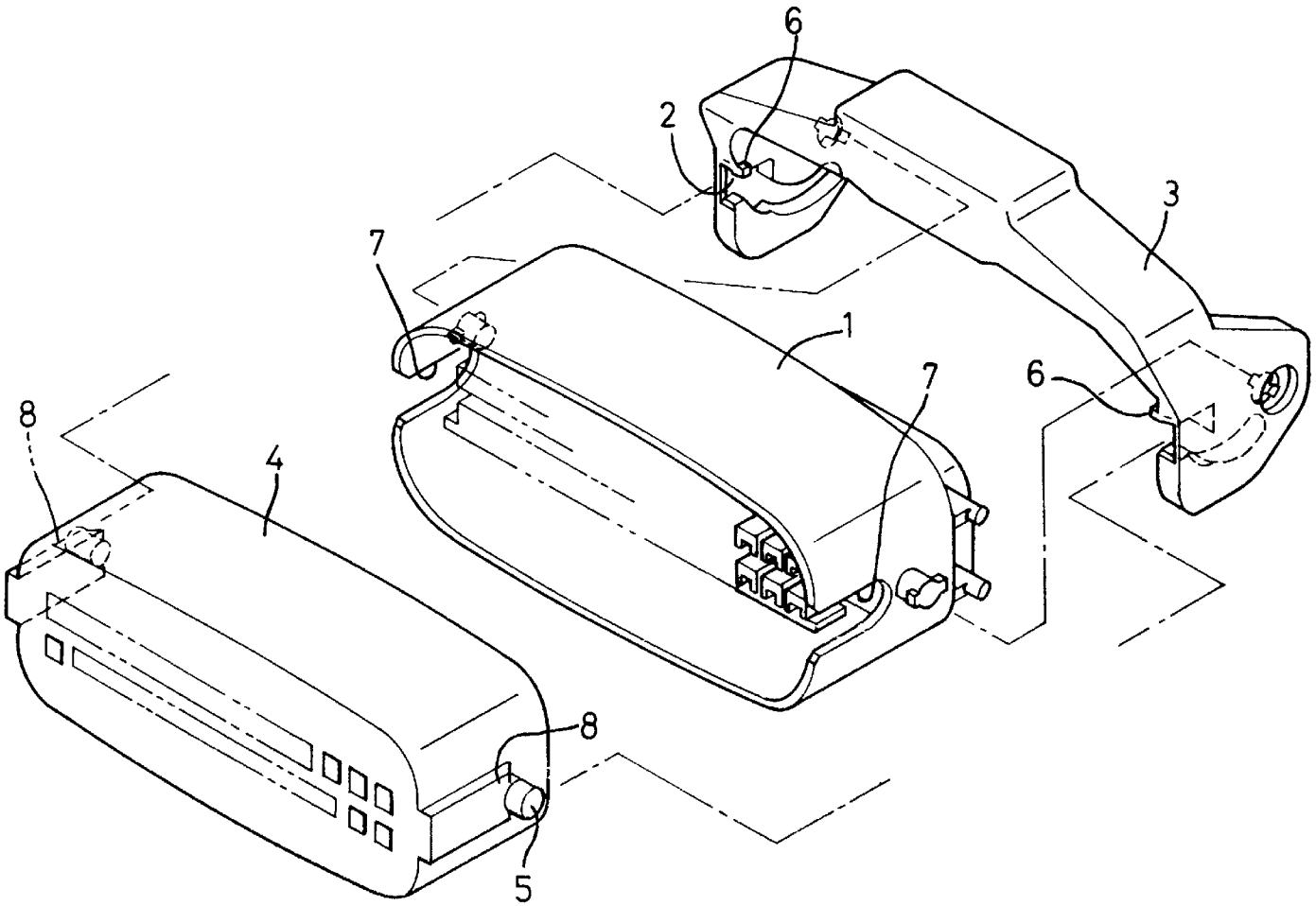
FIG. 24 is an exploded perspective view of a conventional lever-type connector.
Figure 25:
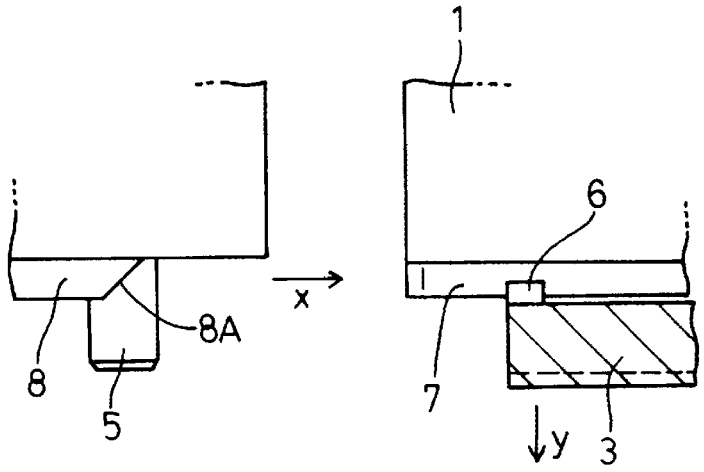
FIG. 25 is a partial enlarged section of FIG. 24.

On the other hand, as shown in FIG. 23, the rear end of the locking protrusion 26 rides on the second pressing portion 40 by passing through the male housing-side second guiding surface 40A and slides in contact with the lower rib 38 continuous with the second pressing portion 40, whereby an outwardly deformed state of the cam plate portion 21 is continued. At this time, a state where the locking protrusion 26 is completely pushed out from the escaping groove 14 is continued since a projection dimension of the lower rib 38 is so set that the lower rib 38 slightly projects from the outer surface of the female receptacle 12 as described above.

However, in this embodiment, the projection height of the lower rib 38 is so set that a corner part between the inner surface of the coupling portion 25 and the partial connection locking portion 25C is disposed inwardly of (closer to the female housing 10) than the top part 36C of the first pressing portion 36 as shown in FIG. 22. That is, since the coupling portions 25 and the rear slopes 36 of the first pressing portions come into contact when the both housings 10, 30 are going to move in separating directions, a partially connected state is set in which easy separation of the both housings 10, 30 is suppressed.

After the rotation restriction of the lever 20 is released, the female housing 10 and the male housing 30 are pulled toward each other by the cam action of the cam grooves 23 and the cam pins 33 and the connection proceeds according to the rotation of the lever 20. Note that the locking portions 35 of the cam pins 33 lock the step portions 27 of the cam grooves 23 as the cam pins 33 move toward the back sides of the cam grooves 23.

When the lever 20 is rotated to the connection end position, the connection of the female housing 10 and the male housing 30 is completed and the operating portion 22 of the lever 20 is locked by the resilient locking piece 15 of the female housing 10. In this way, the rotation of the lever 20 is restricted.

Next, functions and effects are described. The lever-type connector 100 of this embodiment includes the female housing 10 having the female receptacle 12, the male housing 30 having the cam pins 33 and to be fit into the female receptacle 12, and the lever 20 rotatably provided on the female housing 10 and having the cam grooves 23 for receiving the cam pins 33, the cam pins 33 being introduced into the cam grooves 23 of the lever 20 at the initial position in the connection initial stage of the both housings 10, 30, the both housings 10, 30 being connected by the cam action between the cam grooves 23 and the cam pins 33 as the lever 20 is rotated. The female receptacle 12 of the female housing 10 is formed with the escaping grooves 14, which are open forward in the connecting direction and into which the cam pins 33 are insertable. The lever 20 is provided with the locking protrusions 26 projecting toward the escaping grooves 14 and capable of holding the lever 20 in the rotation restricted state from the initial position by locking the edge parts 14C of the escaping grooves 14. The male housing 30 is provided with the first pressing portions 36 projecting outwardly of the male housing 30 and configured to come into contact with the lever 20 and deform the lever 20 in a direction separating from the female housing 10 when the cam pins 33 enter the cam grooves 23 of the lever 20 at the initial position, and the second pressing portions 40 projecting outwardly of the male housing 30 and configured to come into contact with the locking protrusions 26 by entering the escaping grooves 14 together with the cam pins 33 and push the locking protrusions 26 in directions to be disengaged from the edge parts 14C of the escaping grooves 14, thereby releasing the rotation restricted state of the lever 20. When the both housings 10, 30 are connected, the first pressing portions 36 first come into contact with the lever 20 and the second pressing portions 40 are set to come into contact with the locking protrusions 26 with the lever 20 deformed in the direction separating from the female housing 10.

According to the above configuration, the locked state of the locking protrusions 26 to the escaping grooves 14 can be released by deforming the lever 20 in two stages by the first and second pressing portions 36, 40. Thus, as compared to a conventional configuration not provided with the first pressing portions 36, a contact angle between the second pressing portions 40 and the locking protrusions 26 can be reduced more than before and forces applied to the second pressing portions 40 and the locking protrusions 26 can be reduced. Hence, the shape degradation (squeezing) of the second pressing portions 40 and the locking protrusions 26 can be suppressed. Further, a force required to connect the both housings 10, 30 can be reduced and workability is improved.

Further, the coupling portion 25 coupling the end parts of the facing groove walls 23C, 23D of the cam groove 23 on the side opposite to the female housing 10 is provided at the entrance 23A of the cam groove 23 into which the cam pin 33 is introduced, and the first pressing portion 36 moves the lever 20 in the direction separating from the female housing 10 by coming into contact with the coupling portion 25.

According to the above configuration, a specific configuration for bringing the first pressing portion 36 into contact with the lever 20 can be realized.

Further, the first pressing portion 36 projects in the projecting direction of the cam pin 33 from the tip of the cam pin 33. According to this configuration, the first pressing portion 36 can be provided by a simple configuration.

Further, the part of the coupling portion 25 disposed on the side of the entrance 23A of the cam groove 23 and on the side of the female housing 10 serves as the lever-side first guiding surface 25A inclined obliquely with respect to the moving direction of the first pressing portion 36 to guide the first pressing portion 36 to the inner side of the coupling portion 25, and the part of the coupling portion 25 disposed on the side opposite to the entrance 23A serves as the partial connection locking portion 25C intersecting the moving direction of the cam pin 33.

According to the above configuration, because of the lever-side first guiding surface 25A, the lever 20 can be smoothly deformed by the first pressing portion 36. Further, when the first pressing portion 36 passes over the coupling portion 25, the coupling portion 25 is hooked to the rear slope 36B of the first pressing portion 36, thereby suppressing a receding movement of the first pressing portion 36. Thus, the partially connected state can be set in which the female housing 10 and the male housing 30 are hardly separated.

OTHER EMBODIMENTS (1) Although the front end 40A1 of the male housing-side second guiding surface 40A is located slightly forward of the front end 36A1 of the male housing-side first guiding surface 36A in the above embodiment, a positional relationship of a male housing-side first guiding surface and a male housing-side second guiding surface is not limited to that of the above embodiment. For example, the male housing-side first guiding surface may be located forward of or at the same position as the male housing-side second guiding surface. In short, any configuration may be adopted as long as the first pressing portion first comes into contact with the coupling portion and, thereafter, the second pressing portion comes into contact with the locking protrusion.

(2) Although the second pressing portion 40 is provided on the tip of the cam pin 33 in the above embodiment, a second pressing portion may be provided on a part of a cam pin other than a tip.

(3) Although the lever 20 is deformed up to the position where the locking protrusion 26 is just pushed out from the escaping groove 14 by the first pressing portion 36 in the above embodiment, a locking protrusion may be completely pushed out from an escaping groove by a second pressing portion without a first pressing portion completely pushing the locking protrusion out from the escaping groove. In short, any configuration may be adopted as long as a force applied to the second pressing portion is reduced by the presence of the first pressing portion.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A lever-type connector, comprising:

a first housing including a receptacle;

a second housing including a cam pin, the second housing being fit into the receptacle; and a lever provided rotatably on the first housing, the lever including a cam groove for receiving the cam pin, the cam pin being introduced into the cam groove of the lever at an initial position in a connection initial stage of the both housings, the both housings being connected by a cam action between the cam groove and the cam pin as the lever is rotated, wherein:

the receptacle of the first housing is formed with an escaping groove open forward in a connecting direction, the cam pin being insertable into the escaping groove, the lever is provided with a locking protrusion capable of holding the lever in a rotation restricted state from the initial position by projecting toward the escaping groove and locking an edge part of the escaping groove, the second housing is provided with a first pressing portion projecting outwardly of the second housing and configured to come into contact with the lever and deform the lever in a direction separating from the first housing when the cam pin enters the cam groove of the lever set at the initial position, and a second pressing portion projecting outwardly of the second housing and configured to come into contact with the locking protrusion by entering the escaping groove together with the cam pin and release the rotation restricted state of the lever by pushing the locking protrusion in a direction to be disengaged from the edge part of the escaping groove, and the first pressing portion first comes into contact with the lever and the second pressing portion is set to come into contact with the locking protrusion with the lever deformed in the direction separating from the first housing when the both housings are connected.

2. The lever-type connector of claim 1, wherein:

a coupling portion coupling end parts of facing groove walls of the cam groove on a side opposite to the first housing is provided at an entrance of the cam groove into which the cam pin is introduced, and the first pressing portion moves the lever in the direction separating from the first housing by coming into contact with the coupling portion.

3. The lever-type connector of claim 2, wherein the first pressing portion projects in a projecting direction of the cam pin from a tip of the cam pin.

4. The lever-type connector of claim 2, wherein a part of the coupling portion disposed on the entrance side of the cam groove and on the first housing side serves as a guiding surface obliquely inclined with respect to a moving direction of the first pressing portion to guide the first pressing portion to an inner side of the coupling portion, and a part of the coupling portion disposed on a side opposite to the entrance serves as a partial connection locking portion intersecting the moving direction of the cam pin.

* * * * *